US009817361B2

(12) United States Patent
Fukasawa et al.

(10) Patent No.: US 9,817,361 B2
(45) Date of Patent: Nov. 14, 2017

(54) CARTRIDGE AND BEARING MEMBER

(71) Applicant: CANON KABUSHIKI KAISHA, Tokyo (JP)

(72) Inventors: Yu Fukasawa, Yokohama (JP); Hiroyuki Munetsugu, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/263,951

(22) Filed: Sep. 13, 2016

(65) Prior Publication Data

US 2017/0075293 A1 Mar. 16, 2017

(30) Foreign Application Priority Data

Sep. 16, 2015 (JP) ..... 2015-183147

(51) Int. Cl.
*G03G 15/08* (2006.01)
*G03G 21/16* (2006.01)
*G03G 21/18* (2006.01)

(52) U.S. Cl.
CPC ..... *G03G 21/1647* (2013.01); *G03G 21/1652* (2013.01); *G03G 21/1676* (2013.01); *G03G 21/1842* (2013.01); *G03G 21/1867* (2013.01)

(58) Field of Classification Search
CPC ..... G03G 21/1647; G03G 21/1652; G03G 21/1676; G03G 21/1842; G03G 21/1867
See application file for complete search history.

(56) References Cited

U.S. PATENT DOCUMENTS 6,289,189 B1 9/2001 Numagami
2010/0189460 A1* 7/2010 Lee ..... G03G 21/1867 399/90
2011/0206412 A1* 8/2011 Tanabe ..... G03G 21/1842 399/111

FOREIGN PATENT DOCUMENTS

JP 2014-119505 A 6/2014

* cited by examiner

*Primary Examiner* — David M Gray
*Assistant Examiner* — Michael Harrison
(74) *Attorney, Agent, or Firm* — Canon U.S.A. Inc., IP Division

(57) ABSTRACT

On a projection plane orthogonal to an axial line of a developing agent bearing member, forming an imaginary region surrounded by a plurality of straight lines and edges of electric contacts, while satisfying first, second, and third conditions, disposes the entirety of a positioning region inside an imaginary region. The first condition is that each of the ends of the plurality of straight lines is situated at an edge of the electric contacts or at the center of the developing agent bearing member. The second condition is that the center of the developing agent bearing member is situated at an intersection of the plurality of straight lines, or upon one of the straight lines. The third condition is that each of the straight lines is stipulated so that the area of the imaginary region is maximal, within the constrictions of the first and second conditions.

3 Claims, 16 Drawing Sheets

CARTRIDGE AND BEARING MEMBER

BACKGROUND OF THE INVENTION

Field of the Invention

The present invention relates to an electrophotographic image forming apparatus (also referred to as an "image forming apparatus"), and to a cartridge detachably mounted to the apparatus main unit of the image forming apparatus.

An image forming apparatus forms images on a recording medium using an electrophotographic image forming process. Examples of image forming apparatuses include electrophotographic copiers, electrophotographic printers (e.g., laser beam printers, LED printers, etc.), facsimile apparatuses, word processors, and so forth.

A cartridge is an arrangement where at least one of an electrophotographic photosensitive drum (also referred to as "photosensitive drum") that is an image bearing member and a process unit (e.g., developing agent bearing member (also referred to as "developing roller")) that acts upon the photosensitive drum has been formed into a cartridge. The cartridge is detachably mounted to the image forming apparatus. Both the photosensitive drum and the developing roller may be integrally formed into a single cartridge, or separately formed as different cartridges. The former, where both the photosensitive drum and developing roller are included, is referred to as a "process cartridge. In the latter, the arrangement including the photosensitive drum is referred to as a "drum cartridge", and the arrangement including the developing roller is referred to as a "developing cartridge". The term "image forming apparatus main unit" refers to the remainder of the image forming apparatus after removal of the cartridge(s).

Description of the Related Art

Conventionally, image forming apparatuses have used the cartridge system where process cartridges, drum cartridges, and developing cartridges are detachably mounted to the main unit of the image forming apparatus. According to these cartridge systems, maintenance of the image forming apparatus can be performed by the user him/herself, without having to depend on a field engineer for service, which has markedly improved ease of use. Accordingly, these cartridge systems are in widespread use in image forming apparatuses.

Positioning portions are provided to the cartridge, to position the cartridge in the image forming apparatus. There also are provided cartridges having memory for communicating with a power supply portion that supplies power from the image forming apparatus and with the image forming apparatus to record information of the cartridge, in order to control the image forming process (e.g., Japanese Patent Laid-Open No. 2014-119505).

The positions of a process unit and electric contacts provided to the cartridge, serving as an interface portion with the image forming apparatus are preferably highly precise, from the perspective of image quality stability and reducing the size of the image forming apparatus and cartridge. For example, the cartridge includes the photosensitive drum, and multiple electric communication units such as electric contacts and memory, as interface portions with the image forming apparatus.

Inside the main unit of the apparatus the cartridge is positioned by being pressed upwards by a cartridge lifter provided to the main unit of the apparatus so as to press the cartridge against an abutment portion of a deep-side frame. A positioned portion provided to the cartridge, that is abutted against the deep-side frame by being pressed upwards is provided near the photosensitive drum. That is to say, the positioning portion is at a position away from the electric contacts and memory. This tends to result in larger error in the position of the electric contacts and memory within the main unit of the apparatus. Conventionally, stable electric communication has been realized by forming a mechanism that can follow positional error of the electric contacts of the cartridge. This has been performed by managing the dimensions of parts making of the cartridge at a high level of precision, and forming units of multiple parts at the electric contact portion of the main unit of the apparatus.

SUMMARY OF THE INVENTION

A cartridge detachably mountable to an apparatus main unit of an image forming apparatus, the cartridge includes: a developing agent bearing member; a plurality of electric contacts each electrically connecting to the apparatus main unit; and a positioning region where the cartridge is positioned in a mounting direction of being mounted to the apparatus main unit, by coming into contact with the apparatus main unit. On an a projection plane orthogonal to an axial line of the developing agent bearing member, forming an imaginary region surrounded by a plurality of straight lines and edges of the electric contacts, while satisfying first, second, and third conditions, disposes the entirety of the positioning region is disposed inside the imaginary region. The first condition is that each of the ends of the plurality of straight lines is situated at an edge of the electric contacts or at the center of the developing agent bearing member. The second condition is that the center of the developing agent bearing member is situated at an intersection of the plurality of straight lines, or upon one of the straight lines. The third condition is that each of the straight lines is stipulated so that the area of the imaginary region is maximal, within the constrictions of the first and second conditions.

Further features of the present invention will become apparent from the following description of exemplary embodiments with reference to the attached drawings.

DESCRIPTION OF THE EMBODIMENTS

A cartridge and electrophotographic image forming apparatus according to the present invention will be described with reference to the drawings. The electrophotographic image forming apparatus will be described exemplified by a laser beam printer main unit, and a drum cartridge and developing cartridge detachably mounted to the laser beam printer main unit. In the following description, the longitudinal direction of the drum cartridge and developing cartridge is a direction generally parallel with a rotation axis L1 of a photosensitive drum and a rotation axis L0 of a developing roller. The rotation axis L1 of the photosensitive drum and rotation axis L0 of the developing roller are directions orthogonal to a conveyance direction of a recording medium. A transverse direction of the drum cartridge and the developing cartridge is a direction generally orthogonal to the rotation axis L1 of the photosensitive drum and rotation axis L0 of the developing roller. The direction in which the drum cartridge and developing cartridge are mounted to and detached from the laser beam printer main unit is the transverse direction of the cartridges in the embodiment. Note that reference symbols in the description are for referencing the drawings, and do not restrict the configuration.

First Embodiment

Description will proceed in the following order.

(1) Overall description of image forming apparatus (2) Description of electrophotographic image forming process (3) Configuration description of cleanerless system (4) Configuration description of drum cartridge C (5) Configuration description of developing cartridge B1

(6) Configuration description of positioning developing cartridge B1 as to apparatus main unit A1

Figure 2:
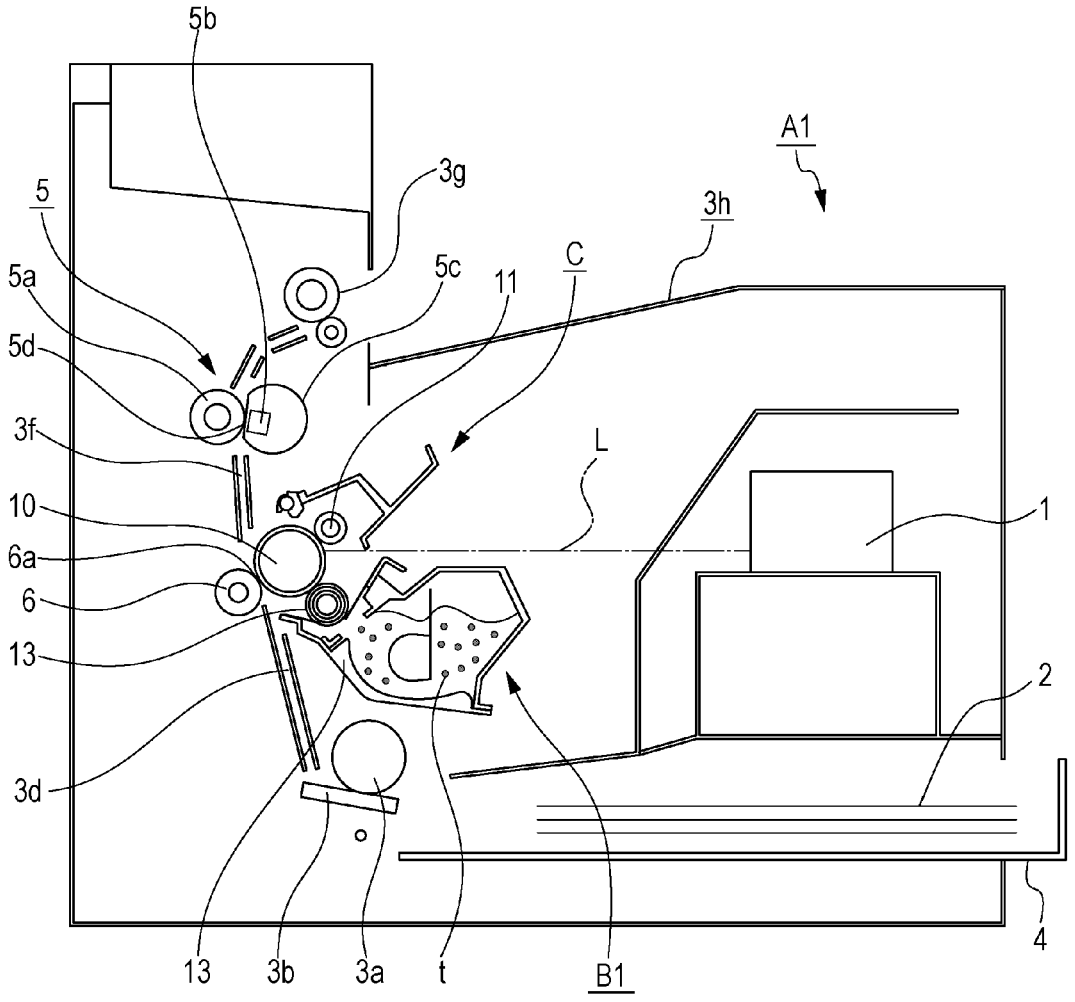
FIG. 2 is a side cross-sectional view of an image forming apparatus.

(7) Configuration description of contact/separation of developing cartridge B1 to/from drum cartridge C (8) Description of positioning portion of developing cartridge B1 and interface portions (1) Overall Description of Image Forming Apparatus First, the overall configuration of an image forming apparatus to which an embodiment of the present invention has been applied will be described with reference to FIG. 2. FIG. 2 is a side cross-sectional explanatory diagram of the image forming apparatus. The image forming apparatus illustrated in FIG. 2 forms images by developing agent t on a recording medium 2 by electrophotographic image forming processing, in accordance with image information communicated from an external device such as a personal computer or the like. The developing cartridge B1 and drum cartridge C are provided so as to be attachable and detachable to and from an apparatus main unit A1 by the user. Examples of the recording medium 2 include recording paper, label sheets, OHP sheets, cloth, and so forth. The developing cartridge B1 also has a developing roller 13 serving as a developing agent bearing member, and so forth. The drum cartridge C has a photosensitive drum 10 serving as an image bearing member, a charging roller 11, and so forth.

The surface of the photosensitive drum 10 is uniformly charged by the charging roller 11, by voltage applied from the apparatus main unit A1. The surface of the photosensitive drum 10 that has been charged is then irradiated by a laser beam L from an optical unit 1 in accordance with image information, and an electrostatic latent image is formed on the photosensitive drum 10 in accordance with the image information. This electrostatic latent image is developed by the developing agent t, by a later-described developing unit, thereby forming a developed image on the surface of the photosensitive drum 10.

The recording medium 2 accommodated in a sheet feed tray 4 is separated and fed one sheet at a time, being regulated by a feed roller 3*a* and a separating pad 3*b* in contact therewith, synchronously with formation of the developed image. The recording medium 2 then is conveyed by a conveyance guide 3*d* to a transfer roller 6 serving as a transfer unit. The transfer roller 6 is urged so as to come into contact with the surface of the photosensitive drum 10.

Next, the recording medium 2 passes a transfer nip 6*a* formed by the photosensitive drum 10 and the transfer roller 6. Voltage of opposite polarity as the developed image is applied to the transfer roller 6 at this time, thereby transferring the developed image formed on the surface of the photosensitive drum 10 onto the recording medium 2.

The recording medium 2 onto which the developed image has been transferred is regulated by a conveyance guide 3*f* and conveyed to a fixing unit 5. The fixing unit 5 has a drive roller 5*a* and a fixing roller 5*c* into which is built in a heater 5*b*. Heat and pressure are applied to the recording medium 2 when passing through a nip 5*d* formed by the drive roller 5*a* and fixing roller 5*c*, thereby fixing the developed image transferred into the recording medium 2. Accordingly, an image is formed on the recording medium 2. Thereafter, the recording medium 2 is conveyed by a discharge roller pair 3*g* and discharged at a discharge unit 3*h*.

(2) Description of Electrophotographic Image Forming Process

Figure 3:
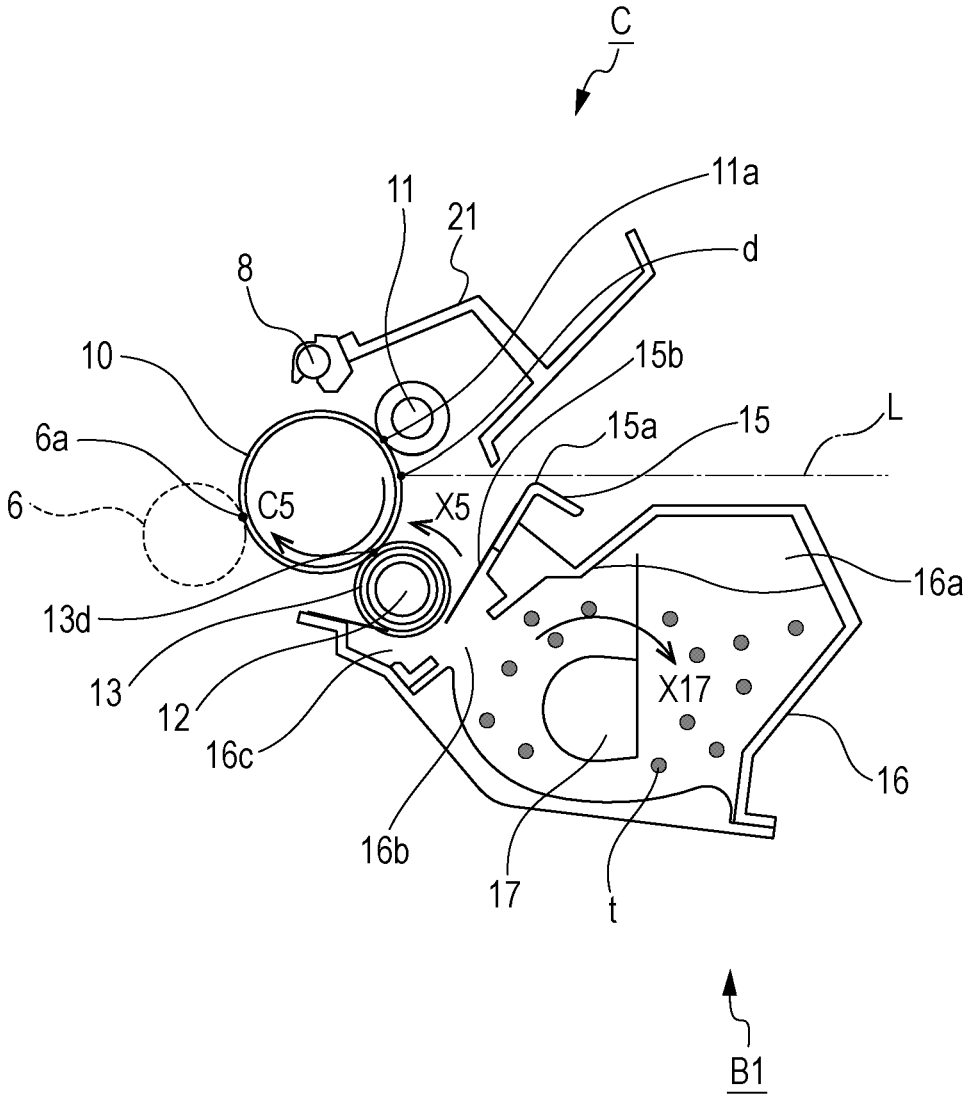
FIG. 3 is a cross-sectional view of a developing cartridge and drum cartridge.

Next, an electrophotographic image forming process to which an embodiment of the present invention has been applied will be described with reference to FIG. 3. FIG. 3 is a cross-sectional explanatory diagram of the developing cartridge B1 and drum cartridge C. As illustrated in FIG. 3, the developing cartridge B1 includes the developing roller 13 serving as a developing unit, a developing blade 15, and so forth, in a developer container 16. The drum cartridge C has the photosensitive drum 10, charging roller 11, and so forth, in a cleaning frame 21.

The developing agent t accommodated in a developing agent storage unit 16*a* of the developer container 16 is fed from an opening 16*b* of the developer container 16 into a developing chamber 16*c*, by a developing agent conveying member 17, rotatably supported in the developer container 16, rotating in the direction indicated by the arrow X17. The developing roller 13, in which a magnet roller 12 is built in, is provided in the developer container 16.

Specifically, the developing roller 13 is configured including a shaft portion 13*e* and rubber portion 13*d*. The shaft portion 13*e* is a slender electroconductive cylinder of aluminum or the like, and the middle portion thereof in the longitudinal direction is covered by the rubber portion 13*d* (see FIGS. 7A and 7B). The rubber portion 13*d* covers the shaft portion 13*e* so that the outer shape thereof is coaxial with the shaft portion 13*e*. The developing roller 13 attracts the developing agent t in the developing chamber 16*c* to the surface of the developing roller 13 by the magnetic force of the magnet roller 12. Thus, the developing roller 13 bears the developing agent. That is to say, the developing roller 13 serves as a developing agent bearing member that bears developing agent on the surface thereof.

The developing blade 15 is configured including a support member 15*a* made up of a metal plate, and an elastic member 15*b* made from urethane rubber, a stainless steel plate, or the like, and is provided so that the elastic member 15*b* elastically comes into contact with the developing roller 13 with a constant contact pressure. Rotation of the developing roller 13 in a rotation direction X5 regulates the amount of the developing agent t adhering to the surface of the developing roller 13, and imparts a triboelectric charge to the developing agent t. Accordingly, a developing agent layer is formed on the surface of the developing roller 13. Rotation in the rotation direction X5 of the developing roller 13, to which voltage has been applied from the apparatus main unit A1 and that is in contact with the photosensitive drum 10, supplies the developing agent t to a developing region on the photosensitive drum 10.

In a case of a contact developing system such as in the present embodiment, maintaining a state where the developing roller 13 is constantly in contact with the photosensitive drum 10 as illustrated in FIG. 3 may deform the rubber portion 13*d* of the developing roller 13. The developing roller 13 is preferably separated from the photosensitive drum 10 when not developing.

The charging roller 11 is provided in contact with the outer peripheral surface of the photosensitive drum 10, rotatably supported by the cleaning frame 21 and urged toward the photosensitive drum 10. A detailed configuration will be described later. The charging roller 11 uniformly charges the surface of the photosensitive drum 10 by application of voltage from apparatus main unit A1. The voltage to be applied to the charging roller 11 is set to a value so that the potential difference between the surface of the photosensitive drum 10 and the charging roller 11 is equal to or greater than discharge start voltage. Specifically, DC voltage of −1300 V is applied as the charging bias. The surface of the photosensitive drum 10 at this time is uniformly charged by contact charging to a charged potential (dark potential) of −700 V. The charging roller 11 performs driving rotation as to rotation of the photosensitive drum 10 in the present example (described later). The laser beam L from the optical unit 1 forms the electrostatic latent image on the surface of the photosensitive drum 10. The developing agent t is subsequently transferred in accordance with the electrostatic latent image on the photosensitive drum 10 to form a visible image of the electrostatic latent image, thereby forming a developed image on the photosensitive drum 10.

(3) Configuration Description of Cleanerless System

Next, the cleanerless system according to the present example will be described. An example of a so-called cleanerless system, where no cleaning member is provided to remove from the surface of the photosensitive drum 10 transfer residual developing agent t2 remaining on the photosensitive drum 10 without being transferred, is illustrated in the present embodiment.

The photosensitive drum 10 is rotationally driven in the direction of the arrow C5, as illustrated in FIG. 3. A void (upstream void 11*b*) is formed on the upstream side of a charging nip 11*a* that is the contact portion of the charging roller 11 and photosensitive drum 10, when viewed from the rotation direction C5 of the photosensitive drum 10. The transfer residual developing agent t2 remaining on the surface of the photosensitive drum 10 after the transfer step is negatively charged, the same as the photosensitive drum 10, by discharge at this upstream void 11*b*. The surface of the photosensitive drum 10 is charged to −700 V at this time. The transfer residual developing agent t2 charged to negative polarity passes through the charging nip 11*a* without adhering to the charging roller 11, due to the relationship in potential difference (surface potential of photosensitive drum 10=−700 V, potential of charging roller 11=−1300 V).

The transfer residual developing agent t2 that has passed the charging nip 11*a* reaches a laser irradiation position d. The amount of the transfer residual developing agent t2 is not enough to shield the laser beam L of the optical unit, and accordingly does not influence the step of image formation of the electrostatic latent image on the photosensitive drum 10. The transfer residual developing agent t2 that has passed the laser irradiation position d and is at unexposed portions (the surface of the photosensitive drum 10 not subjected to irradiation of laser) is recovered by the developing roller 13 under electrostatic force, at a developing nip 13*k* that is the contact portions of the developing roller 13 and photosensitive drum 10. On the other hand, the transfer residual developing agent t2 at exposed portions (the surface of the photosensitive drum 10 subjected to irradiation of laser) is not recovered by electrostatic force and continues to remain on the photosensitive drum 10. Still, there are cases where some of the transfer residual developing agent t2 is recovered by physical force due to peripheral speed difference between the developing roller 13 and the photosensitive drum 10.

Such transfer residual developing agent t2 remaining on the photosensitive drum 10 without being transferred to the paper is generally recovered to the developer container 16. The transfer residual developing agent t2 recovered at the developer container 16 is mixed with the developing agent t remaining in the developer container 16 and used.

The following two configurations are employed in the present embodiment for the transfer residual developing agent t2 to pass the charging nip 11*a* without adhering to the charging roller 11. The first is that an optical electrostatic charge removal member 8 is provided between the transfer roller 6 and charging roller 11. The optical electrostatic charge removal member 8 is situated at the upstream side of the charging nip 11*a* in the direction of rotation of the photosensitive drum 10 (arrow C5), and performs optical electrostatic charge removal of surface potential of the photosensitive drum 10 that has passed the transfer nip 6*a*, so that stable discharge can be performed at the upstream void 11*b*. The potential of the photosensitive drum 10 before charging is set to around −150 V over the entire region in the longitudinal direction by this optical electrostatic charge removal member 8, so uniform discharge can be performed when charged, and the transfer residual developing agent t2 can be uniformly negatively charged.

The second is that a predetermined peripheral speed difference is provided to the driving rotation of the charging roller 11 as to the photosensitive drum 10. As described above, almost all of the toner is of negative polarity due to discharging, but there is a certain amount of transfer residual developing agent t2 that was not completely negatively charged, and this transfer residual developing agent t2 may adhere to the charging roller 11 at the charging nip 11*a*. Providing the predetermined peripheral speed difference to the driving rotation of the charging roller 11 and the photosensitive drum 10 enables such transfer residual developing agent t2 to be imparted negative polarity by rubbing between the photosensitive drum 10 and charging roller 11. This serves to suppress adhesion of the transfer residual developing agent t2 to the charging roller 11. A charging roller gear 69 is provided to one end of the charging roller 11 in the longitudinal direction thereof, and the charging roller gear 69 engages a drive side flange 24 provided to the same longitudinal-direction end of the photosensitive drum 10. Thus, the charging roller 11 is rotationally driven by rotational driving of the photosensitive drum 10. The peripheral speed of the surface of the charging roller 11 is set to as to be around 105 to 120% of the peripheral speed of the surface of the photosensitive drum 10.

Next, the configuration of the drum cartridge C and developing cartridge B1 to which an embodiment of the present invention has been applied will be described. Note that in the following direction, the side with relation to the longitudinal direction that rotary force is transmitted from the apparatus main unit A1 to the drum cartridge C and developing cartridge B1 will be referred to as "drive side". The other side thereof is the other end of the drum cartridge C and developing cartridge B1, and will be referred to as "nondrive side".

(4) Configuration Description of Drum Cartridge C

Figure 4A:
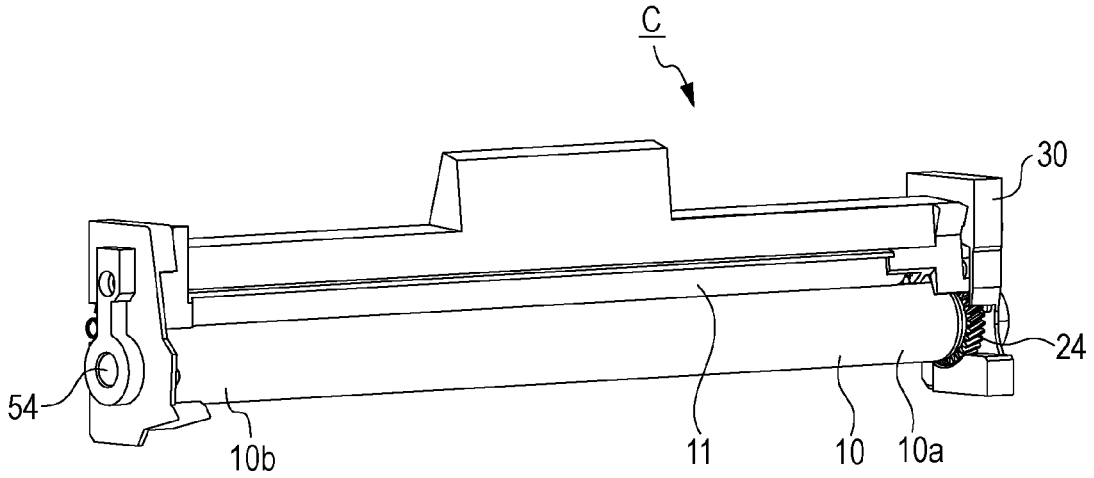
FIGS. 4A and 4B are perspective views of a drum cartridge.
Figure 4B:
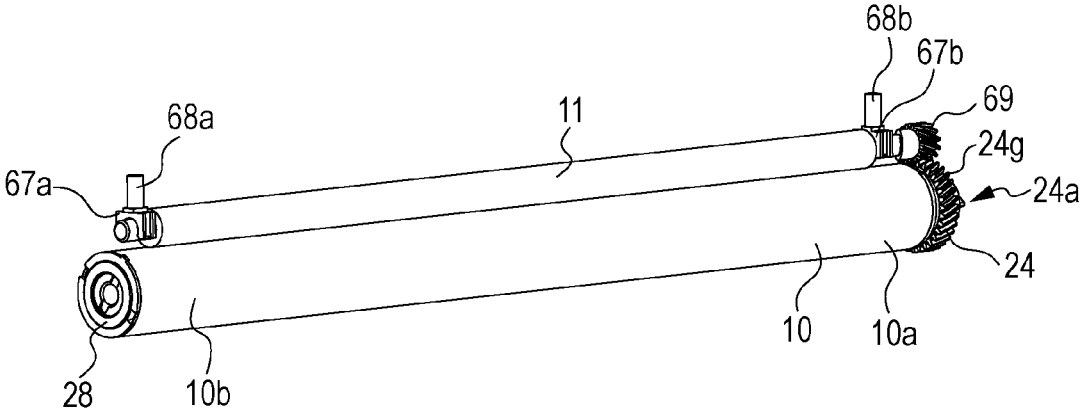

Next, the configuration of the drum cartridge C will be described with reference to FIGS. 4A and 4B. FIG. 4A is a perspective explanatory diagram viewing the drum cartridge C from the nondrive side. FIG. 4B is a perspective explanatory diagram from which the cleaning frame 21, a drum bearing 30, a drum shaft 54, and so forth, have been omitted from illustration for description of around the photosensitive drum 10 and charging roller 11. It can be seen in FIGS. 4A and 4B that the drum cartridge C has the photosensitive drum 10 and charging roller 11. The charging roller 11 is rotatably borne by a charging roller bearing 67*a* and a charging roller bearing 67*b*, and is urged toward the photosensitive drum 10 by a charging roller urging member 68*a* and a charging roller urging member 68*b*.

The drive side flange 24 is integrally fixed to a drive side end portion 10*a* of the photosensitive drum 10, and a nondrive side flange 28 is integrally fixed to a nondrive side end portion 10*b* of the photosensitive drum 10. The drive side flange 24 and nondrive side flange 28 are coaxially fixed to the photosensitive drum 10 by a technique such as swaging, adhesion, or the like. At both end portions in the longitudinal direction of the cleaning frame 21, the drum bearing 30 is fixed to the drive side end portion and the drum shaft 54 to the nondrive side end portion, by a technique such as screwing, adhesion, press-fitting, or the like. The drive side flange 24 integrally fixed to the photosensitive drum 10 is rotationally borne by the drum bearing 30, and the nondrive side flange 28 is rotationally borne by the drum shaft 54.

The charging roller gear 69 is provided to one end of the charging roller 11 in the longitudinal direction, the charging roller gear 69 meshing with a gear portion 24*g* of the drive side flange 24. A drive side end portion 24*a* of the drive side flange 24 has a configuration (omitted from illustration) where rotary force is transmitted from the apparatus main unit A1 side. As a result, the charging roller 11 is also rotationally driven long with the rotational driving of the photosensitive drum 10. As described above, the peripheral speed of the surface of the charging roller 11 is set to as to be around 105 to 120% of the peripheral speed of the surface of the photosensitive drum 10.

(5) Configuration Description of Developing Cartridge B1

Figure 5:
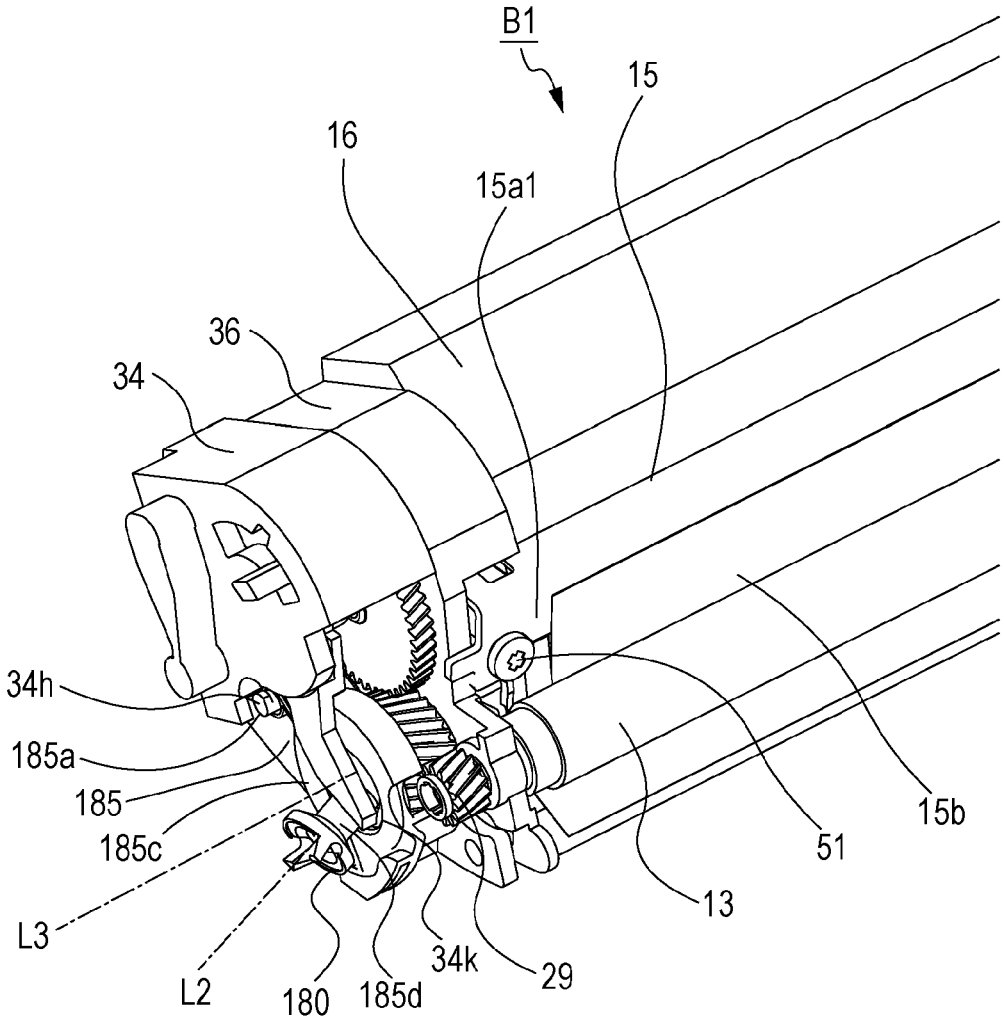
FIG. 5 is a drive side perspective view of a developing cartridge.
Figure 6:
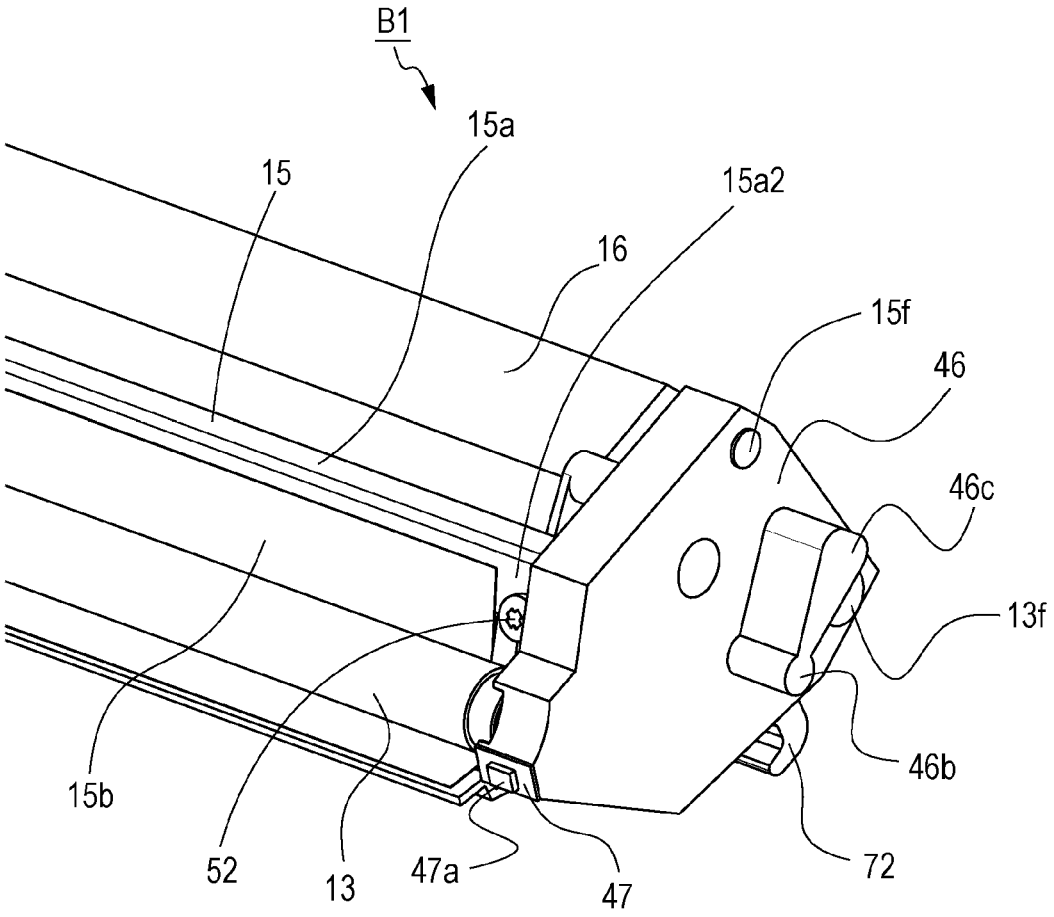
FIG. 6 is a nondrive side perspective view of a developing cartridge.
Figure 7A:
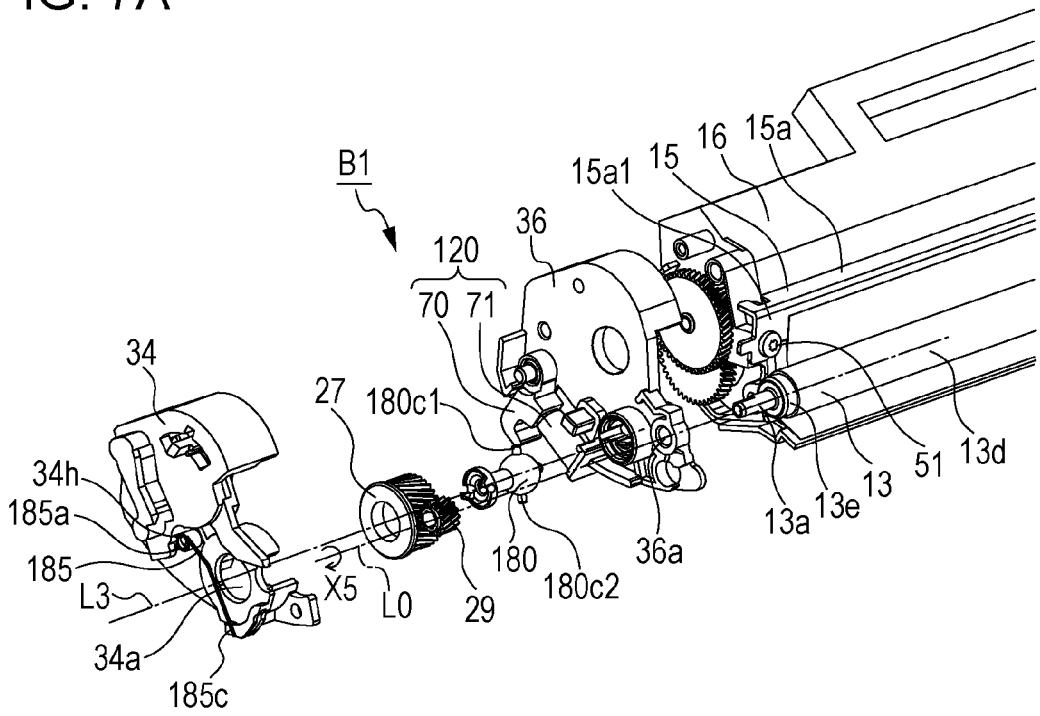
FIGS. 7A and 7B are disassembled perspective views of a drive side of a developing cartridge.
Figure 7B:
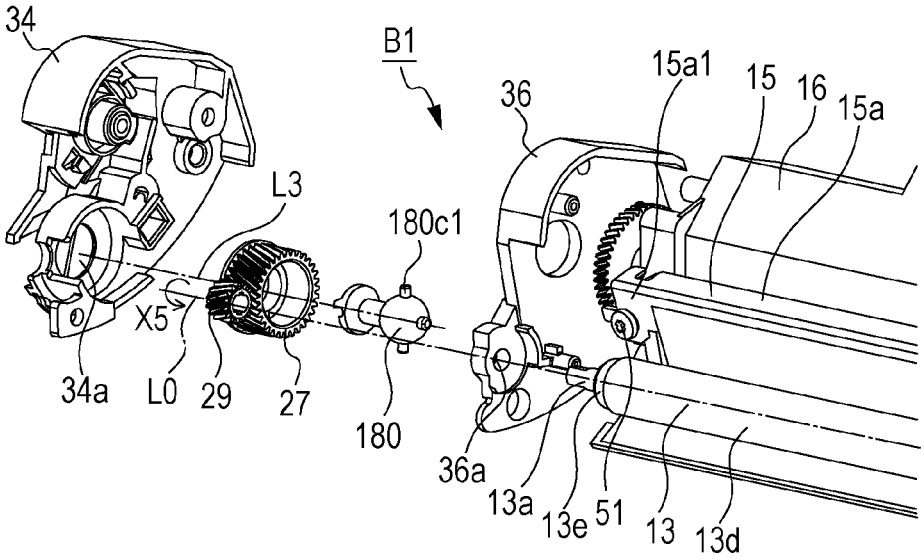
Figure 8A:
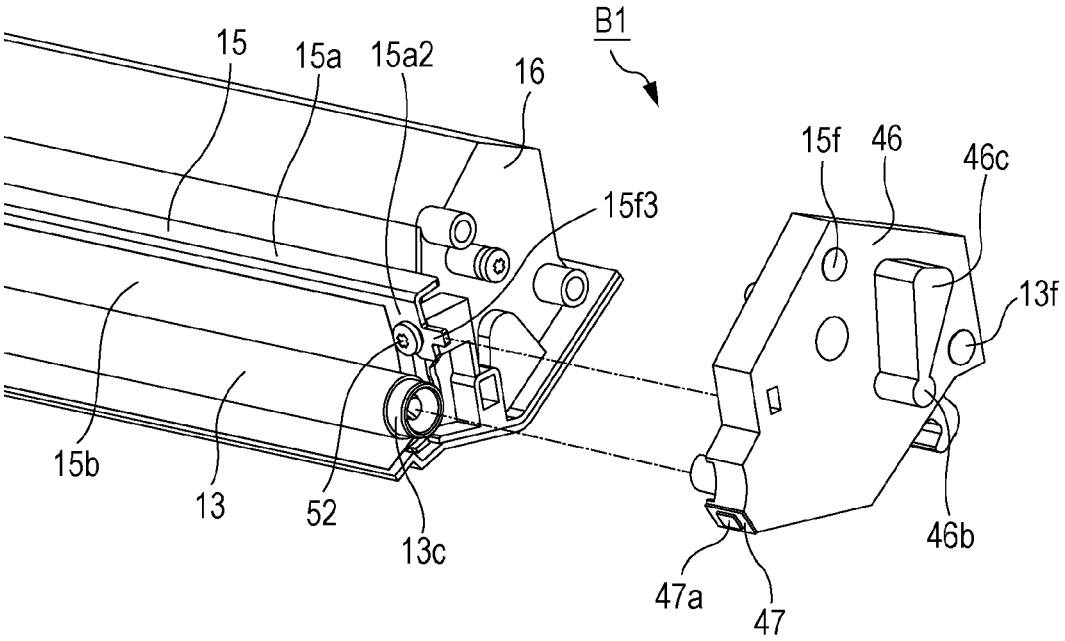
FIGS. 8A and 8B are disassembled perspective views of a nondrive side of a developing cartridge.
Figure 8B:
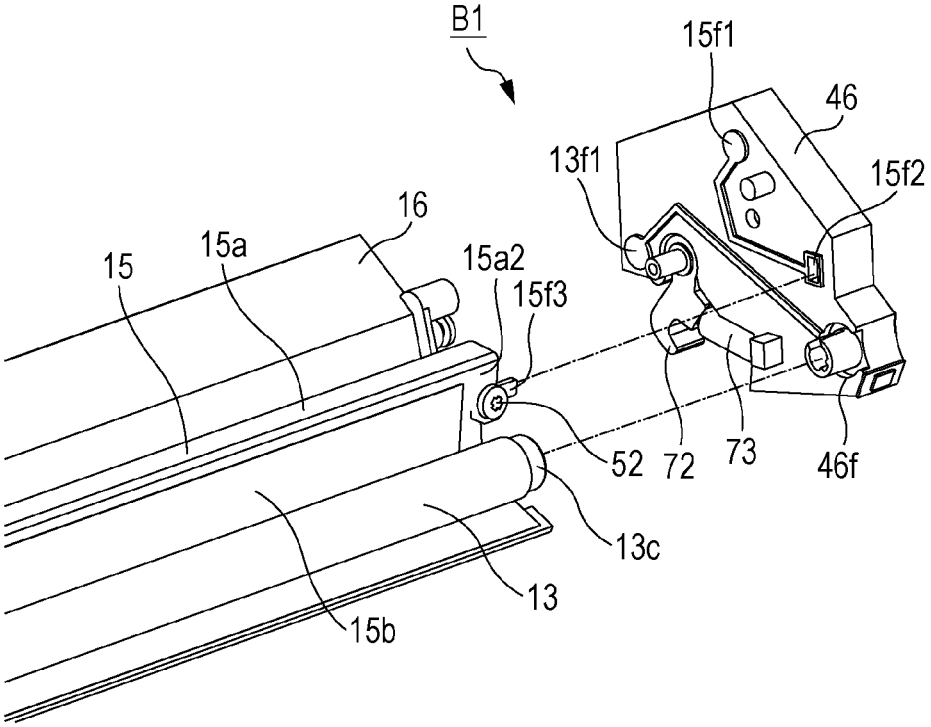

FIG. 5 is a perspective explanatory diagram viewing the developing cartridge B1 from the drive side. FIG. 6 is a perspective explanatory diagram viewing the developing cartridge B1 from the nondrive side. FIGS. 7A and 7B are disassembled views of the developing cartridge B1 with the drive side disassembled, FIG. 7A being from the drive side and FIG. 7B from the nondrive side, and FIGS. 8A and 8B are disassembled views of the developing cartridge B1 with the nondrive side disassembled, FIG. 8A being from the drive side and FIG. 8B from the nondrive side.

Overall Configuration of Developing Cartridge B1

A configuration relating to the overall configuration of the developing cartridge B1 will be described with reference to FIGS. 5 through 8B. The developing roller 13 and developing blade 15 are provided to the developing cartridge B1. The developing blade 15 has a drive side end portion 15*a*1 and a nondrive side end portion 15*a*2 in the longitudinal direction of a support member 15*a* fixed to the developer container 16 by a screw 51 and a screw 52.

A drive side developer bearing 36 and nondrive side developer bearing 46 are provided at the ends of the developer container 16 in the longitudinal direction. The drive side developer bearing 36 and nondrive side developer bearing 46 are bearing members that rotatably bear the respective ends of the shaft of the developing roller 13. A drive side end portion 13*a* fits into a hole 36*a* of the drive side developer bearing 36, and a nondrive side end portion 13*c* fits into a support portion 46*f* of the nondrive side developer bearing 46, so that the developing roller 13 is rotatably borne. A developing roller gear 29 is disposed coaxially with the developing roller 13, on the drive side end portion 13*a* of the developing roller 13 further outward in the longitudinal direction from the drive side developer bearing 36, and is engaged so that the developing roller 13 and the developing roller gear 29 can integrally rotate.

Configuration of Drive Side of Developing Cartridge B1

The configuration relating to the drive side of the developing cartridge B1 will be described with reference to FIGS. 5, 7A, and 7B. The drive side developer bearing 36 of the developing cartridge B1 rotatably supports a drive input gear 27 at the outer side thereof in the longitudinal direction, and the drive input gear 27 meshes with the developing roller gear 29. A coupling member 180 is provided coaxially with the drive input gear 27. A developing side cover 34 is provided at the outermost end portion of the drive side of the developing cartridge B1 so as to cover the drive input gear 27 and so forth from the outer side in the longitudinal direction. The coupling member 180 protrudes to the outside in the longitudinal direction through a hole 34*a* in the developing side cover 34. The coupling member 180 is configured to engage a main unit side drive member 100 provided to the apparatus main unit A1, so that rotary force is transmitted.

The configuration is such that the rotary force thereof is transmitted to a rotary force transmission-receiving portion (omitted from illustration) of the drive input gear 27, via rotary force transmission portions 180*c*1 and 180*c*2 of the coupling member 180. As a result, the configuration is such that the rotary force input to the coupling member 180 is transmitted to the developing roller 13 serving as a rotary member via the drive input gear 27 and developing roller gear 29, and the developing roller 13 rotates on the rotation axis L0 in the rotation direction X5.

A coupling spring 185 is formed of a torsion coil spring, and a positioning portion 185*a* of the coupling spring 185 is supported by a spring supporting portion 34*h* of the developing side cover 34. One end portion 185*b* of the coupling spring 185 is fixed to a spring engaging portion (omitted from illustration) of the developing side cover 34, and an other end portion 185*c* of the coupling spring 185 is in contact with a guided portion 180*d* of the coupling member 180. Thus, in a state where the developing cartridge B1 is alone, i.e., in a state where the developing cartridge B1 is not mounted to the apparatus main unit A1, a rotation axis L2 of the coupling member 180 is inclined as to a rotation axis L3 of the drive input gear 27. The coupling member 180 is held in a state where the guided portion 180*d* thereof is in contact with an inclination regulating portion 34*k* at a portion of the hole 34*a* of the developing side cover 34.

The drive side developer bearing 36 is provided with a drive side contact/separation lever 70 serving as a lever main unit, and a drive side developing pressurizing spring 71 serving as an elastic member. Details will be described later.

Configuration of Nondrive Side of Developing Cartridge B1

The configuration relating to the nondrive side of the developing cartridge B1 will be described with reference to FIGS. 6, 8A, and 8B. A memory board 47 and a contact portion 47*a* serving as an exposed face, are provided as a contact point portion (electric contact) at the nondrive side end portion of the developing cartridge B1. The manufacturing lot and property information of the developing cartridge B1 are recorded in the memory board 47, and used when forming images at the apparatus main unit A1. The memory board 47 is provided with the contact portion 47*a* made of a metal such as iron or copper or the like, and when performing image forming, electrically connects to the apparatus main unit A1 via the contact point portion 47*a* and performs communication. The memory board 47 is fixed to the nondrive side developer bearing 46 by a technique such as press-fitting, adhesion, or the like. A developing roller contact portion 13*f* and developing blade contact portion 15*f* are further provided to the nondrive side developer bearing 46 as a contact point portion (electric contact) at the nondrive side end portion of the developing cartridge B1. In a state where the developing roller 13, to which voltage is applied from the apparatus main unit A1, is in contact with the photosensitive drum 10, as described above, the developing roller 13 is rotated and developing agent t is supplied from the photosensitive drum 10 to the developing region. Specifically, in the present configuration, −300 V is applied to the developing roller 13 and −600 V to the developing blade for uniform contact charging, as bias of voltage applied from the apparatus main unit A1. Conduction is secured from the developing roller 13 to the developing roller contact portion 13*f* and from the developing blade 15 to the developing blade contact portion 15*f* by electroconductive resin, coming into contact with contacts disposed on the apparatus main unit A1, whereby voltage is applied to the developing roller 13 and developing blade 15. The contact portion 47*a* is an electric contact for electric communication, and the developing roller contact portion 13*f* and developing blade contact portion 15*f* are electric contacts for application of voltage (electric power supply).

The nondrive side developer bearing 46 is configured by double-shot injection molding, where two types of resin material are integrally molded. A bearing base portion 46*g* that is a first molded member is molded using an insulating polystyrene material, and the developing roller contact portion 13*f* and developing blade contact portion 15*f* are molded using an electroconductive polyacetal resin including carbon black. Thus, the above-described conduction can be secured. Note that the method of conduction, resin materials, and molding methods may be selected taking into consideration functionality such as strength and so forth, cost, and the like, and the above is not restrictive. Details of the contact position relationship between the contacts of the nondrive side end portion and the apparatus main unit A1 will be described in detail later.

The nondrive side developer bearing 46 is provided with a nondrive side contact/separation lever 72 serving as a lever main unit, and a nondrive side developing pressurizing spring 73 serving as an elastic member. Details will be described later.

(6) Configuration Description of Positioning Developing Cartridge B1 as to Apparatus Main Unit A1

Figure 9:
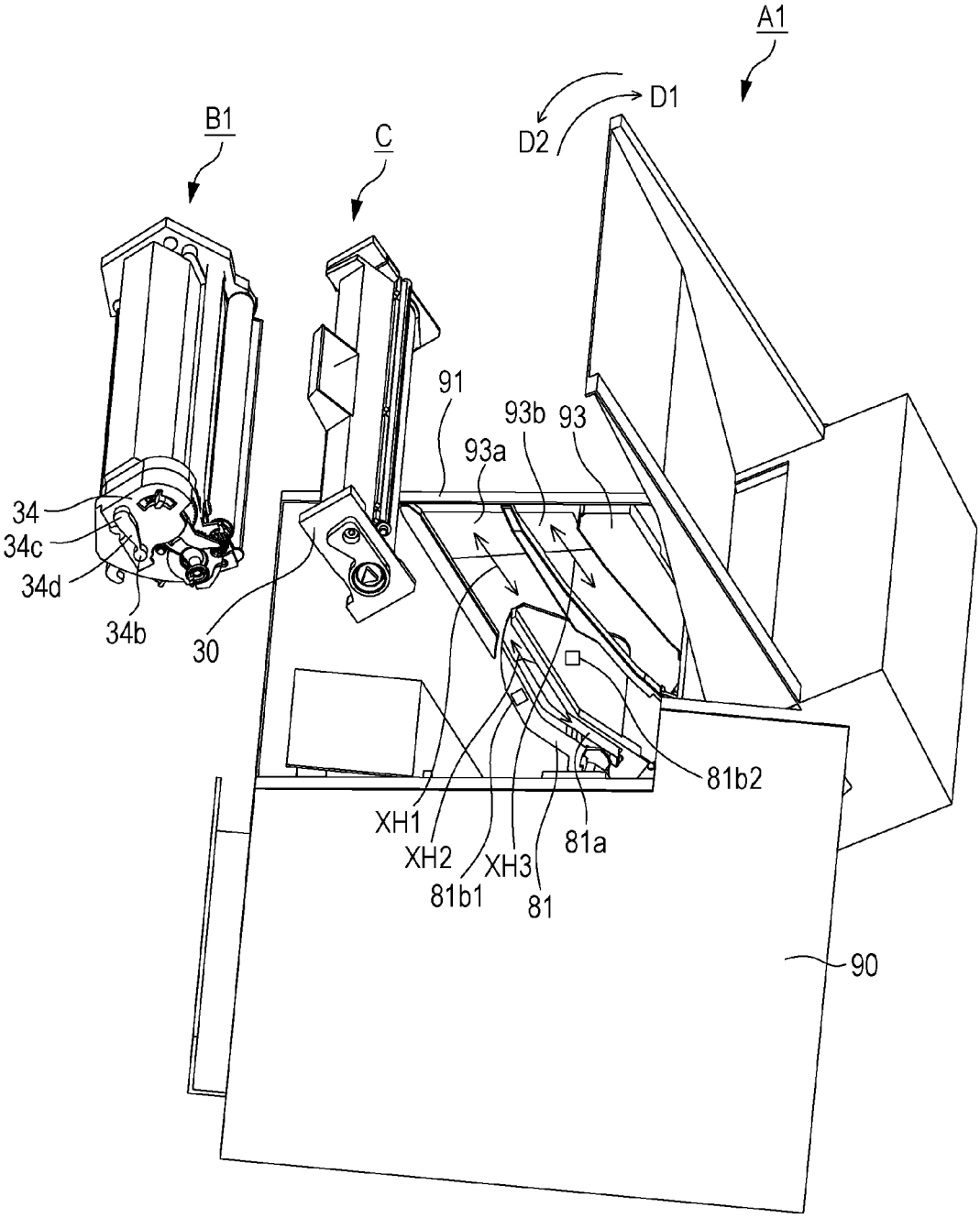
FIG. 9 is a drive side perspective view of a main unit of an apparatus and cartridges.
Figure 10:
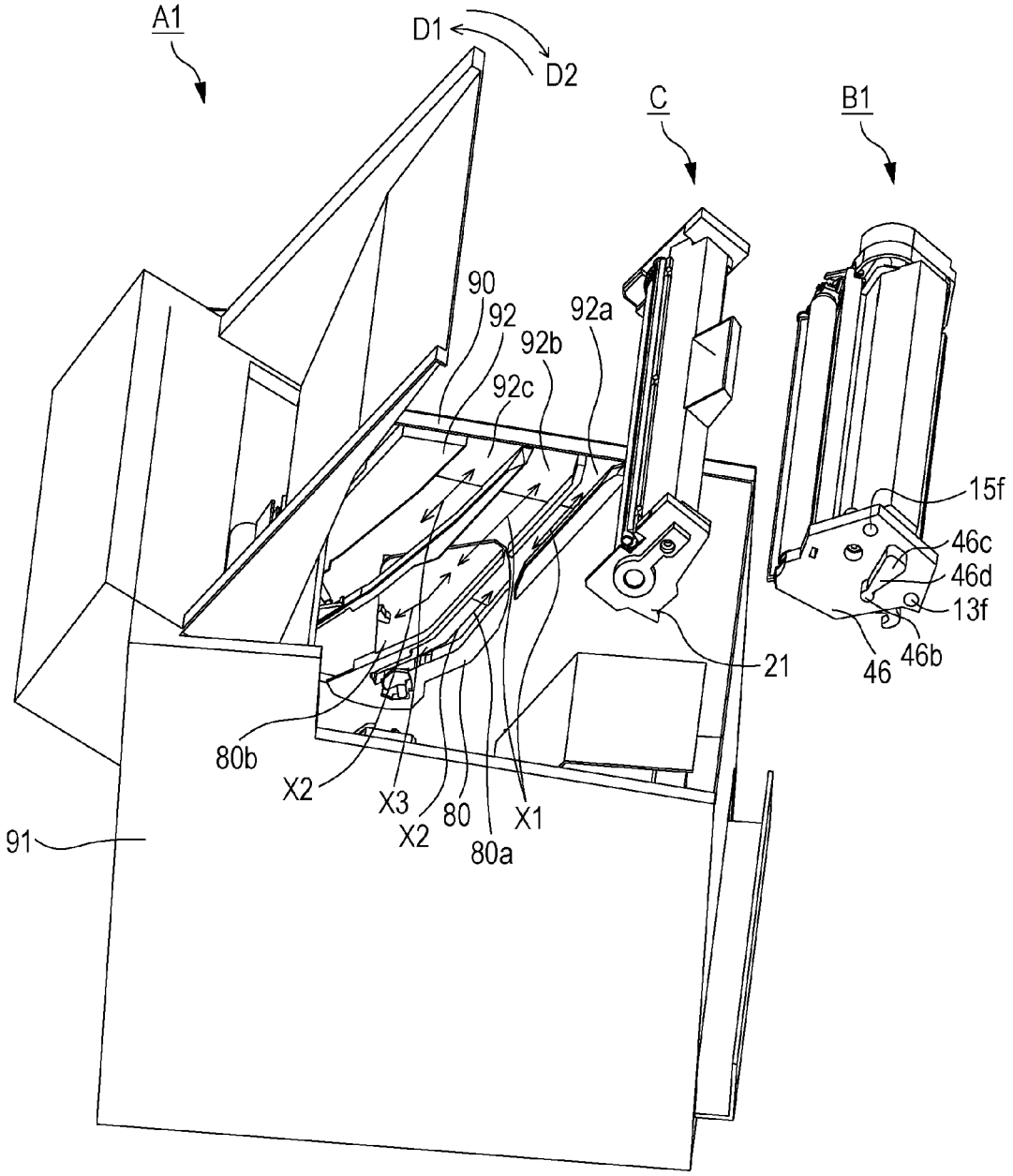
FIG. 10 is a nondrive side perspective view of a main unit of an apparatus and cartridges.

Next, positioning of the developing cartridge B1 as to the apparatus main unit A1 will be described with reference to the drawings. FIG. 9 is a perspective explanatory diagram viewing the apparatus main unit A1 from the nondrive side, and FIG. 10 is a perspective explanatory diagram viewing the apparatus main unit A1 from the drive side. FIGS. 11A through 11D are explanatory diagrams illustrating the process of the developing cartridge B1 being mounted to the apparatus main unit A1, as viewed from the drive side.

The developing cartridge B1 is provided with a guided portion 46*d* having a positioning portion 46*b* and a rotation stopping portion 46*c* on the nondrive side developer bearing 46, as illustrated in FIG. 9. Also, the developing side cover 34 is provided with a guided portion 34*d* having a positioning portion 34*b* and a rotation stopping portion 34*c*, as illustrated in FIG. 10. The positioning portion 46*b* of the nondrive side developer bearing 46 and the positioning portion 34*b* of the developing side cover 34 are portions that position the developing cartridge B1 in the mounting direction (the direction in which the developing cartridge B1 is mounted to the apparatus main unit) in the present embodiment. The rotation stopping portion 46*c* of the nondrive side developer bearing 46 and the rotation stopping portion 34*c* of the developing side cover 34 are portions that position the rotational posture at the time of insertion into the image forming apparatus.

Provided on a drive-side side-plate 90 making up the housing of the apparatus main unit A1 is a drive side guide member 92, and further a drive side swing guide 80 that integrally moves with the developing cartridge B1 inside of the apparatus main unit A1, as illustrated in FIG. 9. The drive side guide member 92 further is provided with a first guide portion 92*a*, a second guide portion 92*b*, and a third guide portion 92*c*. Grooves following a mounting/detaching path X1 of the developing cartridge B1 are formed in the first guide portion 92*a* and second guide portion 92*b*, and a groove following a mounting/detaching path X3 of the drum cartridge C is formed in the third guide portion 92*c*. A guide portion 80*a* is provided to the drive side swing guide 80. The guide portion 80*a* is an extension of the first guide portion 92*a* of the drive side guide member 92, and a groove is formed following a mounting/detaching path X2 of the developing cartridge B1.

Similarly, at the nondrive side of the apparatus main unit A1, provided on a nondrive-side side-plate 91 making up the housing of the apparatus main unit A1 is a nondrive side guide member 93, and further a nondrive side swing guide 81 that moves in the same way as the drive side swing guide 80, as illustrated in FIG. 10. The nondrive side guide member 93 further is provided with a first guide portion 93*a* and a second guide portion 93*b*. Grooves following a mounting/detaching path X1 of the developing cartridge B1 are formed in the first guide portion 93*a*, and a groove following a mounting/detaching path X3 of the drum cartridge C is formed in the second guide portion 93*b*. A guide portion 81*a* is provided to the nondrive side swing guide 81. The guide portion 81*a* is an extension of the first guide portion 93*a* of the nondrive side guide member 93, and a groove is formed following a mounting/detaching path X2 of the developing cartridge B1.

The present configuration uses a configuration of a swing guide that moves integrally with the developing cartridge B1 inside the apparatus main unit A1, Whereby contact/separation of the contact state of the developing roller 13 of the developing cartridge B1 as to the photosensitive drum 10 in the drum cartridge C can be selectively controlled. In a case of a contact developing system such as in the present embodiment, keeping the developing roller 13 constantly in contact with the photosensitive drum 10 as illustrated in FIG. 3 can result in the rubber portion 13*d* of the developing roller 13 deforming, as described above. Accordingly, the developing roller 13 is preferably separated from the photosensitive drum 10 when not developing. The contact/separation configuration will be described later.

The method of mounting the developing cartridge B1 to the apparatus main unit A1 will be described. Inside of the apparatus main unit A1 is exposed by pivoting a main unit cover 94, disposed at the tip of the apparatus main unit A1 so as to be capable of being opened and closed, in an opening direction D1, as illustrated in FIGS. 9 and 10. Thereafter, the guided portion 46*d* of the nondrive side developer bearing 46 of the developing cartridge B1 is engaged with the first guide portion 93*a* of the nondrive side guide member 93 of the apparatus main unit A1. Also, the guided portion 34*d* of the developing side cover 34 of the developing cartridge B1 is engaged with the first guide portion 92*a* of the drive side guide member 92 of the apparatus main unit A1. Accordingly, the developing cartridge B1 is inserted into the apparatus main unit A1 following the mounting/detaching path X1 formed by the first guide portion 92*a* of the drive side guide member 92 and the first guide portion 93*a* of the nondrive side guide member 93.

The developing cartridge B1 inserted into the apparatus main unit A1 following the mounting/detaching path X1 is then inserted into the apparatus main unit A1 following the mounting/detaching path X2. The mounting/detaching path X2 is formed by a guide portion 80*a* of the drive side swing guide 80 and a guide portion 81*a* of the nondrive side swing guide 81.

In further detail, the guided portion 34*d* provided to the developing side cover 34 is first guided by the first guide portion 92*a* provided on the drive side guide member 92 of the apparatus main unit A1. The guided portion 34*d* is then handed from the first guide portion 92*a* to the guide portion 80*a* in this configuration, in conjunction with the mounting processing thereof. The guide portion 80*a* is provided to the drive side swing guide 80 of the apparatus main unit A1.

Similarly, at the nondrive side, the guided portion 46*d* provided to the nondrive side developer bearing 46 is first guided by the first guide portion 93*a* provided on the nondrive side guide member 93 of the apparatus main unit A1. The guided portion 46*d* is then handed to the guide portion 81*a* in this configuration, in conjunction with the mounting processing thereof. The guide portion 81*a* is provided to the nondrive side swing guide 81 of the apparatus main unit A1.

Positioning of Developing Cartridge B1 as to Swing Guide

Figure 11A:
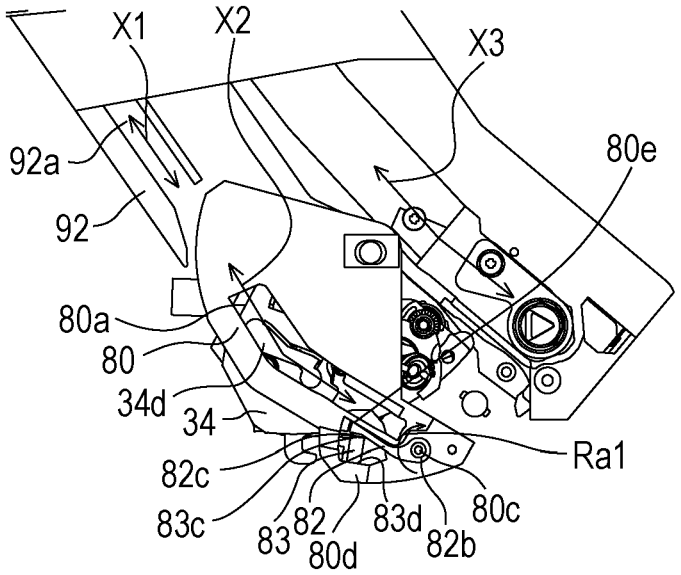
FIGS. 11A through 11D are side views of a drive side in a process of mounting a developing cartridge to a main unit of an apparatus.
Figure 11B:
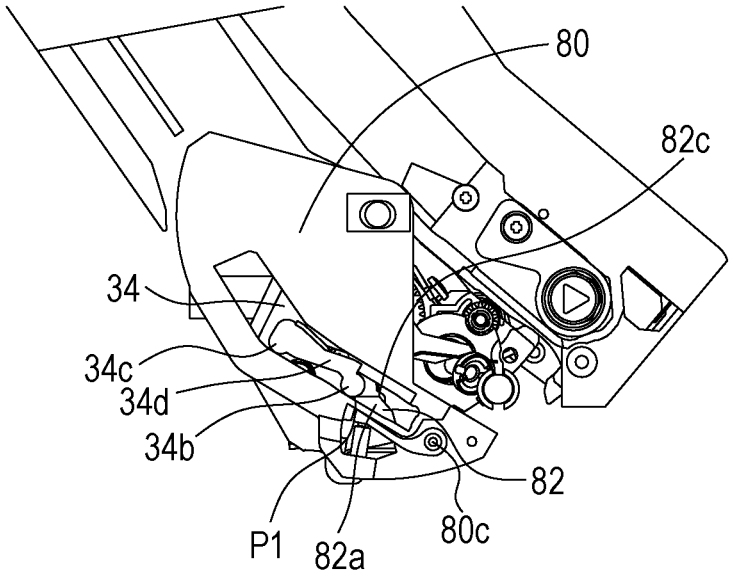

Next, the configuration where the developing cartridge B1 is positioned by the drive side swing guide 80 and nondrive side swing guide 81 of the apparatus main unit A1 will be described. Note that the basic configurations are the same between the drive side and the nondrive side, so description will be made below by way of example of the drive side of the developing cartridge B1. FIGS. 11A through 11D illustrate the state of the developing cartridge B1 and the drive side swing guide 80 in the process of the developing cartridge B1 being mounted to the apparatus main unit A1. FIG. 11A illustrates a state where the guided portion 34*d* provided to the developing side cover 34 of the developing cartridge B1 is guided by the first guide portion 80*a* of the drive side swing guide 80, and the developing cartridge B1 is on the mounting/detaching path X2. FIG. 11B illustrates a state where mounting of the developing cartridge B1 has further been advanced from the state in FIG. 11A, and the positioning portion 34*b* of the guided portion 34*d* of the developing side cover 34 abuts a positioning portion 82*a* of a drive side pressing member 82 provided to the drive side swing guide 80 at a point P1.

The drive side pressing member 82 also has, in addition to the positioning portion 82*a*, a hole 82*b*, a seating face 82*c*, and further a regulating portion 82*d*, as illustrated in FIGS. 11A through 11D. The hole 82*b* engages a boss 80*c* of the drive side swing guide 80, and is rotatably supported centered on the boss 80*c*. One end of a drive side pressing spring 83, that is a compression spring, is in contact with the seating face 82*c*. The other end of the drive side pressing spring 83 is in contact with a seating face 80*d* of the drive side swing guide 80. Accordingly, the drive side pressing member 82 is configured to receive pressing force rotating in the clockwise direction (direction of arrow Ra1) centered on the boss 80*c* of the drive side swing guide 80. Note that the position of the drive side pressing member 82 is regulated by the regulating portion 82*d* thereof abutting a rotation regulating portion 80*e* provided on the drive side swing guide 80.

Figure 11C:
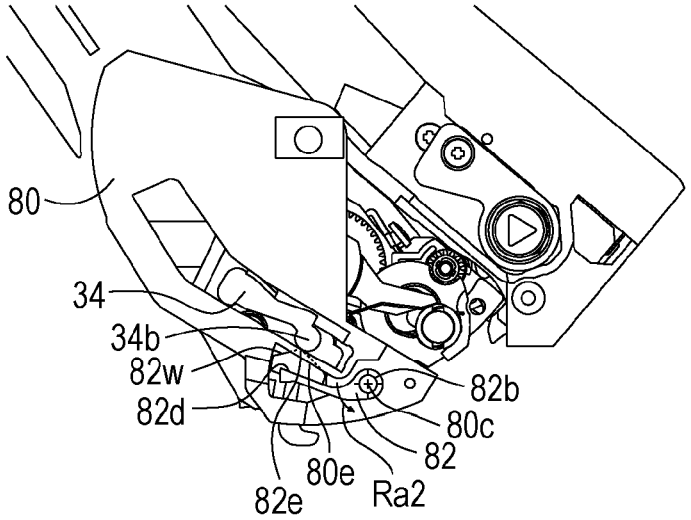

FIG. 11C illustrates a state where mounting of the developing cartridge B1 has further been advanced from the state in FIG. 11A, with the guided portion 34*d* of the developing side cover 34 pressing the drive side pressing member 82 down. Describing in further detail, the guided portion 34*d* of the developing side cover 34 presses the drive side pressing member 82. Accordingly, the drive side pressing member 82 pivots in the counterclockwise direction (direction of arrow Ra2) centered on the boss 80*c* of the drive side swing guide 80 against the pressing force of the drive side pressing spring 83. FIG. 11C illustrates a state in which the positioning portion 34*b* of the developing side cover 34 and an upper edge portion 82*e* of the drive side pressing member 82 are in contact.

Figure 11D:
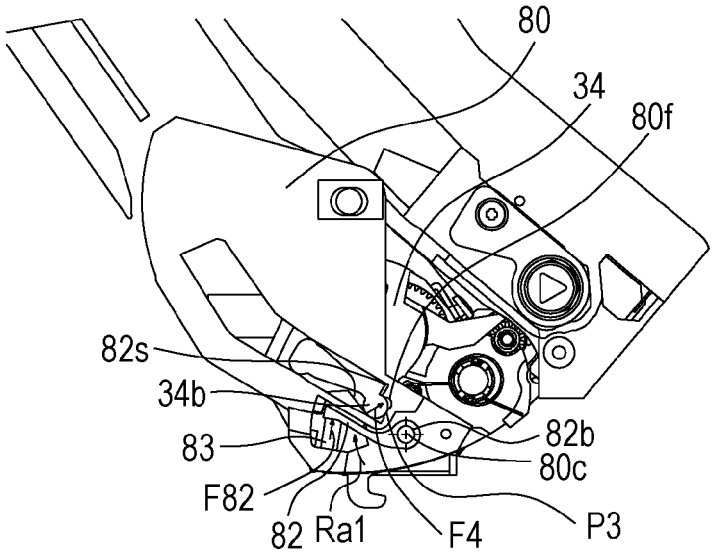

FIG. 11D illustrates a state where mounting of the developing cartridge B1 has further been advanced from the state in FIG. 11C, with the positioning portion 34*b* of the developing side cover 34 and the positioning portion 82*e* of the drive side pressing member 82 in contact. An urging force F4 of the drive side pressing member 82 acts upon the positioning portion 34*b* of the developing side cover 34, and the positioning portion 34*b* comes into contact with a positioning portion 80*f* of the drive side swing guide 80 at a point P3. Accordingly, the drive side of the developing cartridge B1 is positioned as to the drive side swing guide 80.

The configuration of positioning of the positioning portion 46*b* of the nondrive side developer bearing 46 as to the nondrive side swing guide 81 is the same as at the drive side. The nondrive side swing guide 81, a nondrive side pressing member 84, and a nondrive side pressing spring 85, are respectively provided corresponding to the drive side swing guide 80, drive side pressing member 82, and drive side pressing spring 83. Accordingly, the positioning portion 46*b* of the nondrive side developer bearing 46 is positioned and fixed as to the nondrive side swing guide 81.

This will be described in further detail with reference to FIG. 1. The position of the developing cartridge B1 in the mounting direction of mounting to the image forming apparatus main unit is positioned by the positioning portion 46*b* provided to the developing cartridge B1 and the nondrive side swing guide 81 coming into contact. When the developing cartridge B1 is mounted to the apparatus main unit, the positioning portion 46*b* is pressed by the nondrive side pressing member 84, and thus receives force in a direction of arrow Fy at point Fp. A region (contact region, positioning region) Uy of the positioning portion 46*b* is pressed against the nondrive side swing guide 81. As a result, the positioning region Uy of the positioning portion 46*b* is positioned in a state of being in contact with the nondrive side swing guide 81. Accordingly, the developing cartridge B1 is regulated from moving toward the downstream side in the mounting direction. That is to say, the developing cartridge B1 is in a state of not moving in the mounting direction (a state of having been positioned in the mounting direction). According to the above-described configurations, the developing cartridge B1 is positioned and fixed to the swing guides at the drive side and the nondrive side, and is positioned within the apparatus main unit.

(7) Configuration Description of Contact/Separation of Developing Cartridge B1 to/from Drum Cartridge C Next, the pressurized state of the developing roller 13 as to the photosensitive drum 10 and the separated state thereof will be described. In the present embodiment, the contact state of the developing roller 13 of the developing cartridge B1 as to the photosensitive drum 10 of the drum cartridge C, and the separated state thereof, are selectively controlled.

The drive side swing guide 80 is supported as to the drive-side side-plate 90 of the apparatus main unit A1 so as to be capable of pivotal movement in the directions of arrow N5 and arrow N6, as illustrated in FIGS. 12A through 13D. The drive side swing guide 81 also is supported as to the nondrive-side side-plate 91 of the apparatus main unit A1 so as to be capable of pivotal movement in the directions of arrow N5 and arrow N6. The developing cartridge B1 is positioned as to the drive side swing guide 80 and nondrive side swing guide 81. Accordingly, the developing cartridge B1 is in a state capable of pivotal movement in the directions of arrow N5 and arrow N6 inside the apparatus main unit A1.

Further, a drive side apparatus pressing member 150 and nondrive side apparatus pressing member 151 attached to the apparatus main unit A1 are configured to receive driving force from an unshown motor, and to be movable in the direction of arrow N7 and arrow N8, and in the direction of arrow NH7 and arrow NH8.

The drive side apparatus pressing member 150 has a configuration of being capable of engaging the drive side contact/separation lever 70, and the nondrive side apparatus pressing member 151 with the nondrive side contact/separation lever 72. The drive side contact/separation lever 70 and nondrive side contact/separation lever 72 each have a pressed face (first contact surface 70*a* and 72*a*) and a separating face (second contact surface 70*g* and 72*g*). Pressing faces (second contact surfaces 150*b* and 151*b*) and separating faces (150*a* and 151*a*) respectively of the drive side apparatus pressing member 150 and nondrive side apparatus pressing member 151 act thereupon. Accordingly, the contact state and separated state of the photosensitive drum 10 and developing roller 13 can be selected as necessary, by the respectively singular parts that are the drive side contact/separation lever 70 and nondrive side contact/separation lever 72. Hereinafter, a pressure mechanism serving as a contact state, and a separating mechanism serving as a separated state, will be described in detail.

Pressure Mechanism for Contact State

Figure 12A:
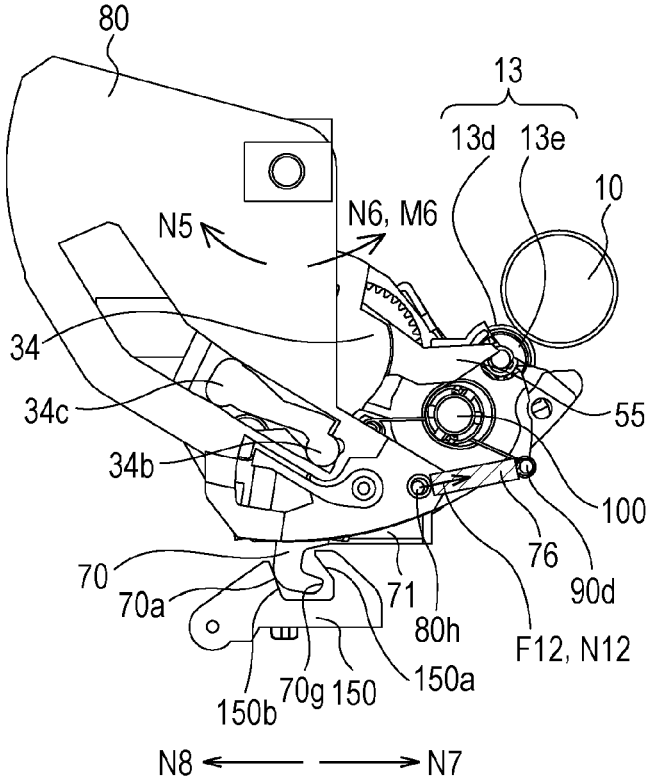
FIGS. 12A and 12B are side views of a drive side of a developing cartridge mounted to a main unit of an apparatus.
Figure 12B:
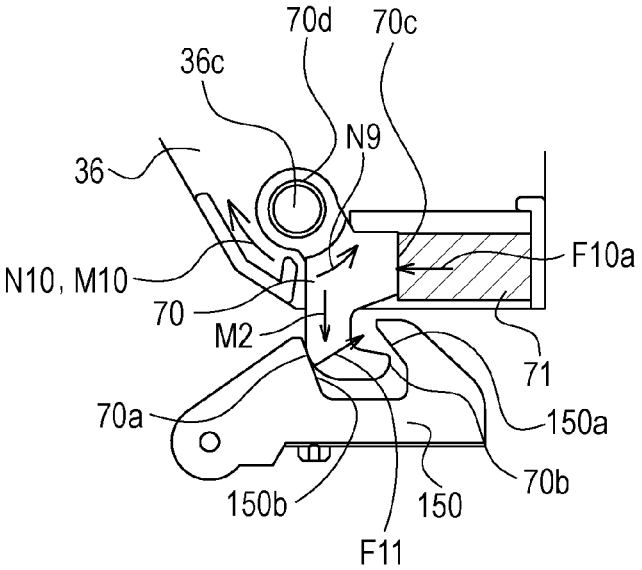

FIGS. 12A and 12B are explanatory diagrams illustrating the contact state of the developing cartridge B1 where the developing roller 13 and photosensitive drum 10 are in contact. The contact pressure mechanism is the same configuration for the drive side and nondrive side, so description will be made in detail regarding the drive side. The second contract surface 150*b* of the drive side apparatus pressing member 150 and the first contact surface 70*a* of the drive side contact/separation lever 70 are in contact, as illustrated in FIGS. 12A and 12B. Accordingly, the drive side contact/separation lever 70 is in a state of having rotated in the direction of arrow N9 in FIG. 12B, against the biasing force of the drive side developing pressurizing spring 71.

The third contact surface 70*c* of the drive side contact/separation lever 70 then compresses the drive side developing pressurizing spring 71, and receives biasing force F10*a* from the drive side developing pressurizing spring 71. As a result moment M10 in the direction of the arrow N10 acts upon the drive side contact/separation lever 70.

At this time, the second contact surface 150*b* of the drive side apparatus pressing member 150 and the first contact surface 70*a* of the drive side contact/separation lever 70 are in contact. Accordingly, the first contact surface 70*a* of the drive side contact/separation lever 70 receives force F11 from the second contact surface 150*b* of the drive side apparatus pressing member 150 so that a moment balanced with the moment M10 acts upon the drive side contact/separation lever 70. Accordingly, this means that external force of the force F11 is acting upon the developing cartridge B1. Also, a drive side urging unit 76 is provided between a protrusion 80*h* of the drive side swing guide 80 and protrusion 90*d* of the drive-side side-plate 90, urging in the direction of arrow N12. Accordingly, this means that external force of the force F12 is acting upon the developing cartridge B1, positioned by the drive side swing guide 80, in the direction of arrow N12.

That is to say, the developing cartridge B1 receives moment M6 in the direction of the developing roller 13 and photosensitive drum 10 coming closer (direction of arrow N6) by the force F11 due to the drive side developing pressurizing spring 71 and the force F12 due to the drive side urging unit 76. The rubber portion 13*d* of the developing roller 13 can be pressed into contact with the photosensitive drum 10 at a predetermined pressure by this moment M6.

Figure 13A:
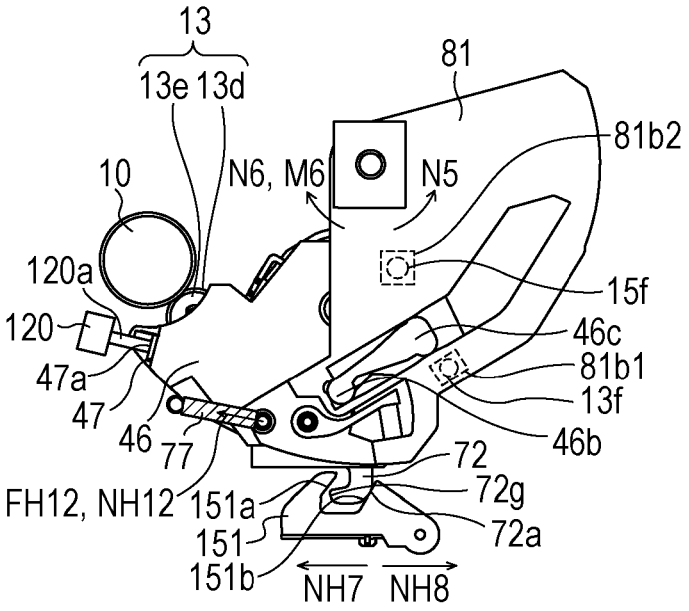
FIGS. 13A through 13D are side views of a nondrive side in a process of mounting a developing cartridge to a main unit of an apparatus.
Figure 13B:
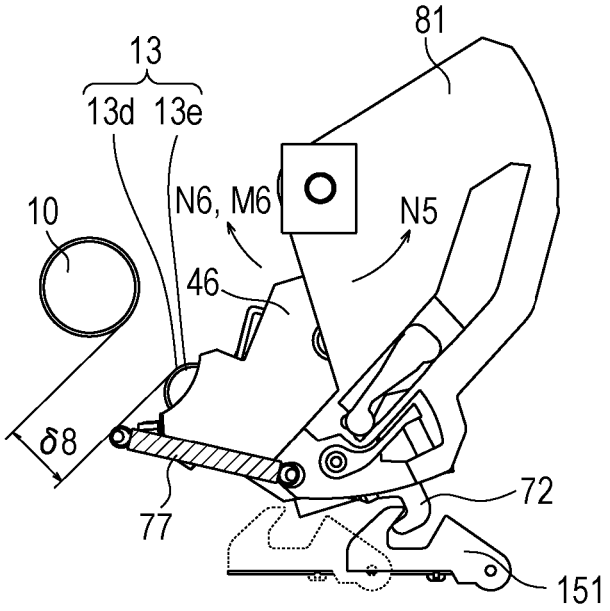
Figure 13C:
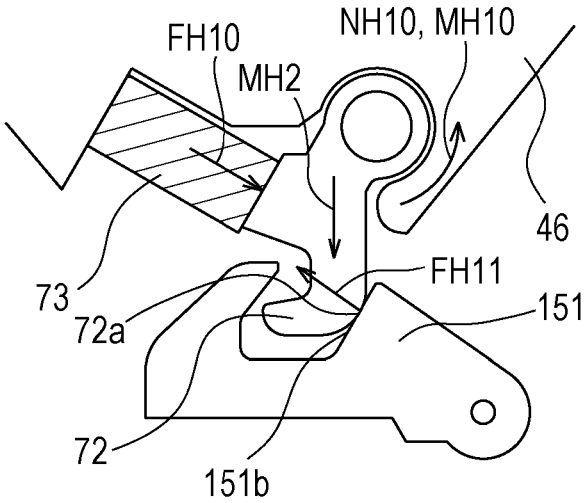

As illustrated in FIGS. 13A and 13C, the second contact surface 151*b* of the nondrive side apparatus pressing member 151 and the first contact surface 72*a* of the drive side contact/separation lever 72 are in contact. In the same way as with the drive side, moment MH10 in the direction of arrow NH10 acts upon the nondrive side contact/separation lever 72 by receiving force urging FH10 from the nondrive side developing pressurizing spring 73. The first contact surface 72*a* receives force FH11 from the second contact surface 151*b* of the nondrive side apparatus pressing member 151, meaning that external force of force FH11 is acting on the developing cartridge B1.

Also, a nondrive side urging unit 77 is provided between the nondrive side swing guide 81 and the nondrive-side side-plate 91 (omitted from illustration in FIGS. 13A through 13D), urging in the direction of arrow NH12, meaning that external force of force FH12 is acting on the developing cartridge B1 in the direction of arrow NH12. Accordingly, the developing roller 13 and photosensitive drum 10 receive the moment M6 in the direction of arrow N6, and is pressed into contact at a predetermined pressure along with the drive side.

Separating Mechanism for Separated State

FIG. 13B is an explanatory diagram illustrating a separated state of the developing cartridge B1, where the developing roller 13 and photosensitive drum 10 are separated. The separating mechanism is the same configuration at the drive side and nondrive side, so description will be made in detail regarding the nondrive side.

Figure 13D:
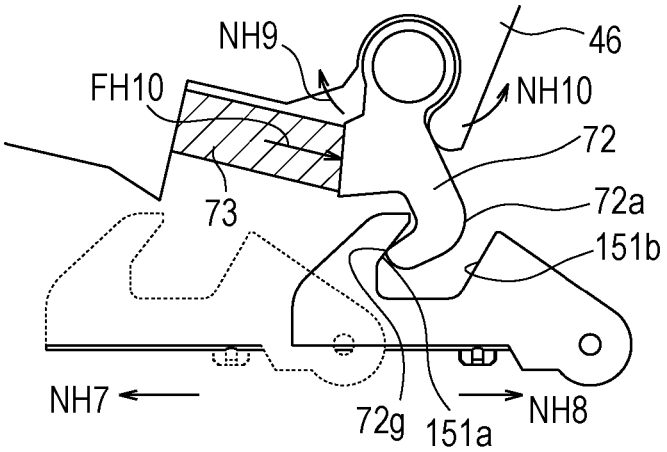

As illustrated in FIGS. 13B and 13D, the first contact surface 151*a* of the nondrive side apparatus pressing member 151 and the second contact surface 72*g* of the nondrive side contact/separation lever 72 are in contact. Accordingly, the nondrive side contact/separation lever 72 is in a state of having rotated in the direction of arrow NH10 in FIG. 13D against the urging force of the nondrive side urging unit 77. Further, the third contact surface 72*c* of the nondrive side contact/separation lever 72 receives urging force FH10 from the nondrive side developing pressurizing spring 73. As a result, the moment MH10 in the direction of arrow NH10 acts upon the nondrive side contact/separation lever 72. At this time, the first contact surface 151*a* of the nondrive side apparatus pressing member 151 and the second contact surface 72*g* of the nondrive side contact/separation lever 72 are in contact. Accordingly, the second contact surface 72*g* of the nondrive side contact/separation lever 72 receives force FH11 from the first contact surface 151*a* of the nondrive side apparatus pressing member 151, so that a moment balanced with the moment MH10 acts upon the nondrive side contact/separation lever 72. Accordingly, this means that external force of the force FH11 is acting on the developing cartridge B1. Thus, the developing cartridge B1 pivots in the direction of arrow N5 due to the nondrive side apparatus pressing member 151 moving in the direction of arrow N8. At this time, the developing roller 13 and the photosensitive drum 10 are in a state separated by a gap of a distance δ8.

(8) Description of Positioning Portion of Developing Cartridge B1 and Interface Portions The configuration for positioning interface portions that the developing cartridge B1 has with high precision will be described next. Note that the interface portions that the developing cartridge B1 illustrated in the present embodiment has are the functional procession that function by coming into contact with or by engaging the apparatus main unit A1 or drum cartridge C. Examples of interfaces regarding which particularly highly precise positioning is desirable include the developing roller 13, the coupling member 180, the contact portions that are electric contacts (memory board 47, developing roller contact portion 13*f*, and developing blade contact portion 15*f*), and so forth.

The positions of the interface portions of the developing cartridge B1 as to the apparatus main unit A1 and drum cartridge C are preferably highly precise, from the perspective of image quality stability and reducing the size of the image forming apparatus and cartridge. For example, the position of the developing roller 13 that the developing cartridge B1 has as to the photosensitive drum 10 that the drum cartridge C has, having been positioned in the image forming apparatus, is positioned with high precision. Accordingly, information can be printed with high precision, without misregistration as to the recording medium 2 when forming images.

Also, the contact portions of the developing cartridge B1 (memory board 47, developing blade contact portion 15*f*, and developing roller contact portion 13*f*) a positioned with high precision as to the power supply portions of the image forming apparatus. Accordingly, maximum reduction in size can be realized while taking into consideration the shape tolerance and position tolerance of the contact portions and the power supply portions, thereby enabling the size of the image forming apparatus and the cartridge to be reduced.

As described above, the nondrive side developer bearing 46 according to the present embodiment has an interface portion regarding which highly precision positioning is desired. Included are a developing roller contact portion 13*f*1 and developing blade contact portion 15*f*1 to apply voltage to the memory board 47, developing roller 13, and developing blade 15, as illustrated in FIGS. 1, 8A, and 8B. The interface portions will be described in further detail.

Description will be made regarding the developing roller contact portion 13*f* and developing blade contact portion 15*f*. The developing roller contact portion 13*f* and developing blade contact portion 15*f* are integrally formed of the electroconductive resin of the nondrive side developer bearing 46. Due to having been integrally formed of electroconductive resin, a back surface portion 13*f*1 of the developing roller contact portion 13*f* and a support portion 46*f* are connected. Further, a back surface portion 15*f*1 and a developing blade contact portion 15*f*2 of the developing blade contact portion 15*f* are in contact. Accordingly, the nondrive side end portion 13*c* of the developing roller 13 being rotatably fit to the support portion 46*f* of the nondrive side developer bearing 46 secures conduction. Fitting or gluing a developing blade conducting portion 15*f*3 with the developing blade contact portion 15*f*2, and re-injecting electroconductive resin to the contact portions after having assembled the developing cartridge B1, secures conductivity. Note that methods for conduction are not restricted to the above method.

Conduction between a first power supply portion 81*b*1 of the nondrive side swing guide 81 and the developing roller contact portion 13*f*1, and conduction between a second power supply portion 81*b*2 of the nondrive side swing guide 81 and the developing blade contact portion 15*f*, will be described with reference to FIGS. 9, 10, and 13A. The developing cartridge B1 mounted within the apparatus main unit A1 is positioned and held by the drive side swing guide 80 and nondrive side swing guide 81, as described above. The first power supply portion 81*b*1 and second power supply portion 81*b*2 are configured on the nondrive side swing guide 81 as power supply portions corresponding to the developing roller contact portion 13*f* and developing blade contact portion 15*f*, as illustrated in FIGS. 9 and 10. These first and second power supply portions are for applying applied voltage from the apparatus main unit A1 to the developing cartridge B1.

The developing cartridge B1 held by the nondrive side swing guide 81 is in a contact state where the developing roller 13 and the photosensitive drum 10 are in contact when forming images, as illustrated in FIG. 13A. The first power supply portion 81*b*1 and second power supply portion 81*b*2 of the nondrive side swing guide 81 are provided with power supply contacts (omitted from illustration) formed of leaf springs or the like and having spring properties are disposed at the portions indicated by dotted lines, protruding toward the nondrive side developer bearing 46.

Accordingly, power can be supplied in a stable manner to the developing cartridge B1 positioned and held by the nondrive side swing guide 81. The reason is that, when forming images, contact pressure between the first power supply portion 81*b*1 and the developing roller contact portion 13*f*, and contact pressure between the second power supply portion 81*b*2 and the developing blade contact portion 15*f*, are secured. Note that the contact range of the developing roller contact portion 13*f* and developing blade contact portion 15*f* of the nondrive side developer bearing 46, when the developing cartridge B1 is mounted, needs to be decided taking into consideration part tolerance and so forth, so that contact with the power supply portions of the nondrive side swing guide 81 can be made in a sure manner.

Further, description will be made regarding conduction with a power supply portion 120 provided at a position facing the contact portion 47*a* of the memory board 47. Power is supplied from the power supply portion 120 of the apparatus main unit A1 provided at a position facing the contact portion 47*a* of the memory board 47 fixed to the nondrive side developer bearing 46 when forming images, as illustrated in FIG. 13A.

As described above, the developing cartridge B1 positioned and held by the nondrive side swing guide 81 is subject to pressure on the nondrive side contact/separation lever 72 of the developing cartridge B1 from the nondrive side apparatus pressing member 151, and is in a contact state. In this configuration, the contact portion 47*a* presses the power supply portion 120 of the apparatus main unit A1 in by a predetermined amount by this pressure, from the state before the mounting of the developing cartridge B1.

The power supply portion 120 has a power supply contact 120A, formed of a wire spring or leaf spring or the like and having spring properties, protruding from the power supply portion 120. Contact pressure between the power supply portion 120 and the contact portion 47*a* is secured by external force of the force FH12 in the contact state of the developing cartridge B1, so stable power supply can be realized. Note that the conduction method is not restricted to this method. Note that the contact range needs to be decided taking part tolerance and so forth in to consideration, so that contact of the contact portion 47*a* of the memory board 47 fixed to the nondrive side developer bearing 46 and the power supply portion 120 of the apparatus main unit A1 can be made in a sure manner, when the developing cartridge B1 is mounted.

In the present embodiment, the developing roller 13 and the interface portions of electric contacts are formed as parts with positional precision and dimensional tolerance guaranteed, with the positioning portion 46*b* of the nondrive side developer bearing 46 as a dimensional reference. The positioning portion 46*b* of the nondrive side developer bearing 46 is positioned within a region surrounded by straight lines connecting the interface portions and a developing roller center 13*z* regarding which highly precise positioning is desired, as illustrated in FIGS. 1, 8A, and 8B.

Figure 1:
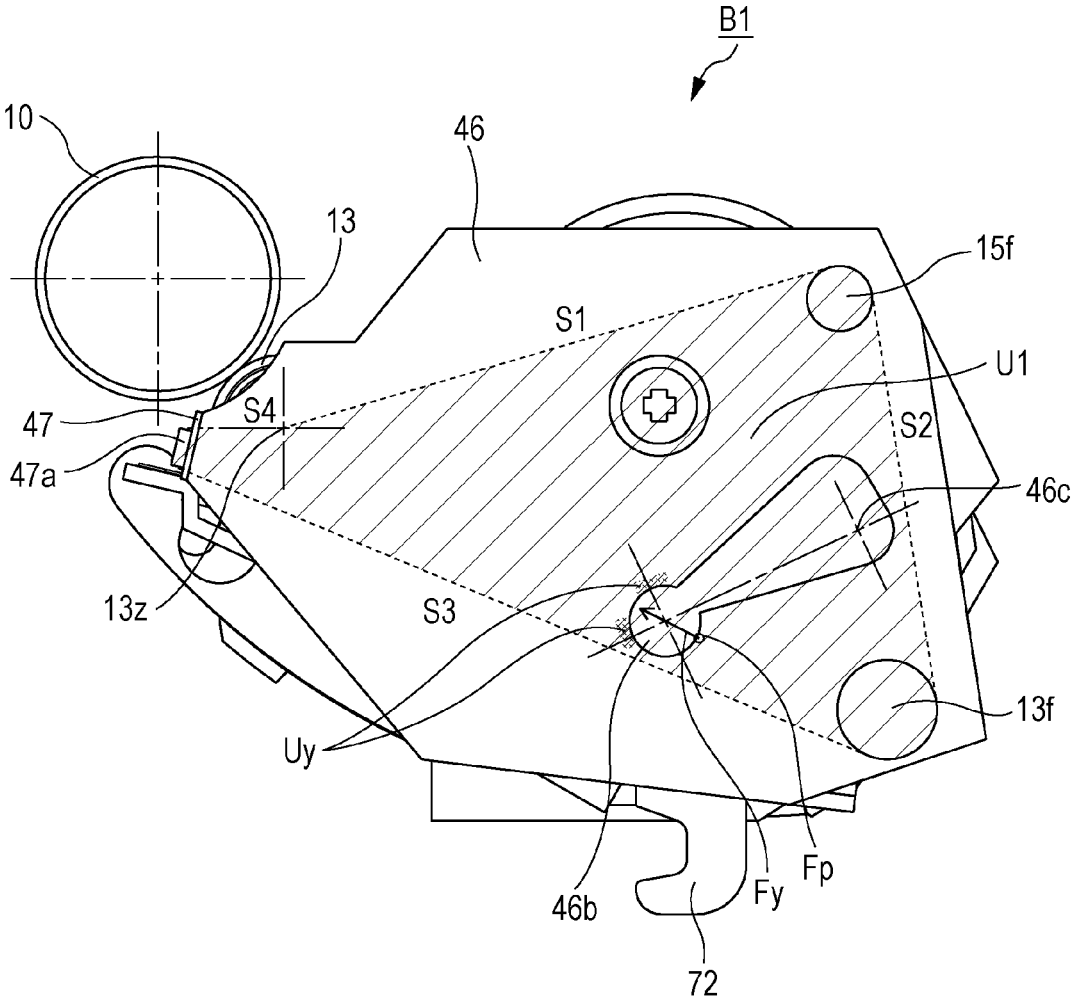
FIG. 1 is a side view of a developing cartridge.

That is to say, positioning the positioning portion 46*b* in an imaginary region U1 that is a generally polygonal shape surrounded by the straight lines S1, S2, S3, and S4, and edges of the electric contacts, as illustrated in FIG. 1, enables the positioning precision as to the interfacing portions at the image forming apparatus side to be raised to a high level. More specifically, the positions of the portions are set so that the entire positioning region Uy of the positioning portion 46*b* coming into contact with the nondrive side swing guide 81 is contained within the imaginary region U1.

Figure 14:
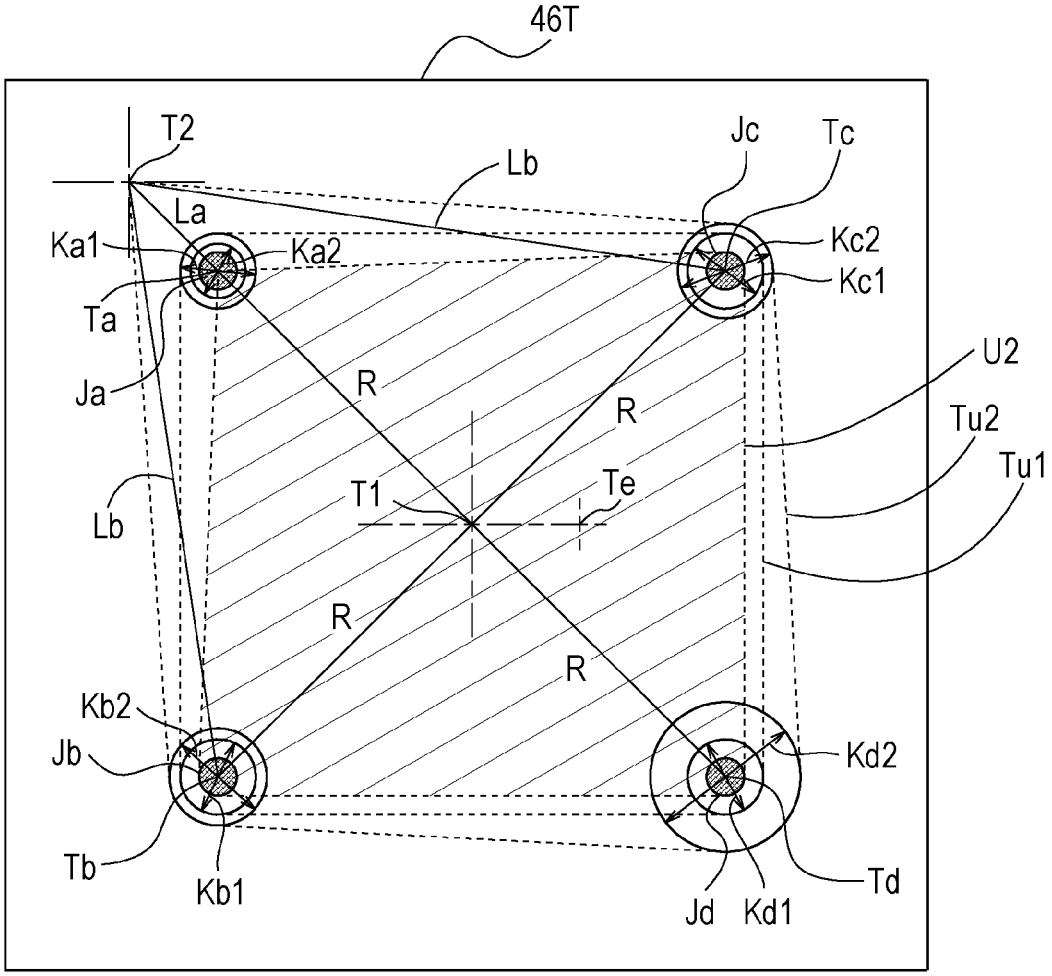
FIG. 14 is a schematic diagram illustrating positions of positioning portions and interface portions.

The effects of situating the positioning portion 46*b* (positioning region Uy, see FIG. 1) in the imaginary region U1 will be described below. FIG. 14 is a simulated diagram illustrating the positioning portion and the interface portions from a cross-sectional direction. Schematically illustrated here are four interface portions regarding which high-precision positioning with positioning portions of the image forming apparatus in the insertion direction is desired, in the same way as the nondrive side developer bearing 46. The four interface portions represent the developing roller 13, the contact portion 47*a* of the memory board 47, the developing roller contact portion 13*f*, and the developing blade contact portion 15*f*.

In FIG. 14, the center points of interface portions Ja, Jb, Jc, and Jd are represented by Ta, Tb, Tc, and Td, respectively. If a center point of a certain positioning portion is T1, T2, the external tolerance range of the interface portions is Ka1, Kb1, Kc1, Kd1, Ka2, Kb2, Kc2, Kd2.

The interface portion Ja represents the developing roller 13, the interface portion Jb represents the contact portion 47*a* of the memory board 47, interface portion Jc represents the developing roller contact portion 13*f*, and the interface portion Jd represents the developing blade contact portion 15*f*. The interface portions are drawn as circles, having the same outer diameters, to facilitate understanding of the description.

Each interface portion is formed as a part 46T, and the positional dimensions are defined with the center points T1 and T2 of the positioning portion as the dimensional reference. Here, center point T1 is situated within a generally polygonal imaginary region U2 of which the range has been set so that the maximum area is formed by the outer shape of the center point Ta of the interface portion Ja and the interface portions Jb, Jc, and Jd. The developing roller 13 that the interface portion Ja represents is required to have high precision regarding the center position, since the developing roller 13 is fit and supported by the nondrive side developer bearing 46. Accordingly, the center position of the interface portion Ja should be defined with high precision. The interface portions Jb, Jc, and Jd represent the contact portions, so the relative position as to the interfacing portions at the image forming apparatus side is required to be highly precise. Accordingly, the outer shape ranges of the interface portions Jb, Jc, and Jd should be set with high precision.

A generally polygonal imaginary region, formed by the center point Ta of the interface portion Ja, and the outer shapes (edges) of the interface portions Jb, Jc, and Jd, so as to have the largest area, is set as U2. Due to the above-described reason, setting the center point T1 within the imaginary region U2 enables the distance tolerance from the center point T1 to the interface portions to be reduced. Here, the center point T1 is situated at a position where the distance R from the center point T1 to each interface portion is equidistant. A center point T2 has been set at a position outside of the range of the imaginary region U2 and close to the interface portion Ja, for the sake of comparison with the center point T1.

The fact that using the center point T1 of the positioning portion as a reference enables the range tolerance of each interface portion to be reduced and precision to be raised in FIG. 14 will be described in further detail. The dimensional range tolerance of each interface portion described here will be described regarding distance tolerance dependent on the distance from the center points T1 and T2 to the center points Ta, Tb, Tc, and Td of the interface portions. The center point T1 is situated at an equal distance R from the center point of each interface portion, and the tolerance depends on the distance R, so an equal tolerance range K1 is obtained.

$$K1=Ka1=Kb1=Kc1=Kd1$$

The center point T2 is defined near the position of the interface portion Ja. The distance from the center point T2 to the center point Ta is distance La, the distance from the center point T2 to the center point Tb is distance Lb, and the distance from the center point T2 to the center point Tc is distance Lc. Comparing the distance tolerances Ka2, Kb2, KC2, and Kd2 to each interface portion in the case of the center point T2 with the distance tolerance K1 from the center point T1 to each interface portion finds $$Ka2=La/R\times K1$$

$$Kb2=Kc2=Lb/R\times K1$$

$$Kd2=(La+R)/R\times K1=(Ka2+1)\times K1$$

so $$Tu1<Tu2$$

where a region connecting the outer dimension ranges of the interfaces is Tu1 for a region according to T1 and Tu2 for a region according to T2.

Accordingly, using the center point T1 of the positioning portion as a reference enables the positional tolerance of the interface portions to be more highly precise, and the formed part 46T can be reduced in size to region Tu1, as compared to region Tu2. The interfacing portion at the image forming apparatus size also can be reduced in size.

Note that FIG. 14 according to the present embodiment illustrates a case of the center point T1 of the positioning portion to be an equal distance R from each interface portion. However, the center point T1 of the positioning portion can be selected by designing the precision of part position tolerance, from the perspective of function, placement, and cost, of each interface portion within the imaginary region U2. That is to say, in a case where there is leeway regarding design placement of the interface portion Jd, the center point T1 of the positioning portion can be decided according to the remaining interface portions Ja, Jb, and Jc, regarding which high precision is desired.

Further, although the center point Te of the rotation stopping portion is situated in the imaginary region U2 in the same way as with the nondrive side developer bearing 46, generally, the longer the distance between the center points T1 and T2 of the positioning portions is, the smaller the tolerance for deciding posture is. That is to say, the precision can be raised further. Accordingly, the center point Te is preferably decided taking into consideration the outer dimensions of the entire part, and part functionality.

As described above, the center point T1 of the positioning portion is defined within the imaginary region U2 of a range formed by the center point Ta of the interface portion Ja, and the outer shapes of the interface portions Jb, Jc, and Jd, so as to have the largest area. Accordingly, the positions of multiple interface portions can be positioned with precision, and reduction in size of the image forming apparatus and cartridge, and stable image quality can be realized.

Returning to FIG. 1, the imaginary region is strictly defined as follows. The developing roller, positioning portion (positioning region), and multiple electric contacts are projected on a projection plane orthogonal to the axial line of the developing roller. On this projection plane, an imaginary region formed by multiple straight lines (S1, S2, S3, and S4) and the edges of the electric contacts (15*f*, 13*f*, and 47*a*), so that first, second and third conditions are satisfied, is the imaginary region U1.

The first condition is that each of the ends of the multiple straight lines (S1, S2, S3, and S4) forming the imaginary region U1 is situated at one of the center 13*z* of the developing roller and edges of the electric contacts (developing blade contact portion 15*f*, developing roller contact portion 13*f*, and contact portion 47*a*).

The second condition is that center 13*z* of the developing roller (center of support portion) is situated at an intersection of different straight lines, or upon one of the straight lines. That is to say, the center 13*z* of the developing roller is situated on the edge of the imaginary region U1.

The third condition is that each of the straight lines is stipulated so that the area of the imaginary region U1 is maximal, within the constrictions of the first and second conditions.

In the present embodiment, the straight line S1 is a straight line of which both ends are at the center 13*z* of the developing roller and the edge of the developing blade contact portion 15*f*. The straight line S2 is a straight line of which both ends connect the edge of the developing blade contact portion 15*f* and the edge of the developing roller contact portion 13*f*. The straight line S3 is a straight line of which both ends connect the edge of the developing roller contact portion 13*f* and the edge of the contact portion 47*a*. The straight line S4 is a line connecting the edge of the contact portion 47*a* and the center 13*z* of the developing roller. Note that on the projection plane, the position of the center 13*z* of the developing roller is the same as the position of the center of the support portion 46*f* (see FIG. 8B) that fits (in contact) with the shaft of the developing roller 13 (nondrive side end portion 13*c*) and supports the shaft.

Connecting the different straight lines by the edges of the electric contacts forms the region U1. The edge of the developing blade contact portion 15*f* connects between the edge of the straight line S1 and the edge of the straight line S2. The edge of the developing roller contact portion 13*f* connects between the edge of the straight line S2 and the edge of the straight line S3. The contact portion 47*a* connects between the edge of the straight line S3 and the edge of the straight line S4.

Both ends of the straight lines S1, S2, S3, and S4 are situated at positions where the area of the imaginary region U1 is maximal, within the constrictions of the first and second conditions. All of the positioning portion 46*b* (positioning region Uy) is included within this imaginary region U1.

A positional relationship suitable for multiple members (the interface portions) in a cartridge has been described above in the present embodiment as an example of a configuration where a developing cartridge is mounted to an apparatus main unit. However, the above-described suitable positional relationship among the various types of interface portions holds even in a case where a process cartridge is mounted to the image forming apparatus main unit and not a developing cartridge. That is to say, the cartridge detachably mountable to the apparatus main unit may be a process cartridge having both a photosensitive drum and developing roller, or a developing cartridge having, of the two, only the one developing roller.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-183147, filed Sep. 16, 2015, which is hereby incorporated by reference herein in its entirety.

What is claimed is:

1. A cartridge detachably mountable to an apparatus main unit of an image forming apparatus, the cartridge comprising:

a developing agent bearing member rotatable about an axial line;

a plurality of electric contacts each electrically connecting to the apparatus main unit; and a positioning portion having a positioning region where the cartridge is positioned in a mounting direction of being mounted to the apparatus main unit, by coming into contact with the apparatus main unit, wherein, on a projection plane orthogonal to the axial line, forming an imaginary region surrounded by a plurality of straight lines and edges of the electric contacts, while satisfying first, second, and third conditions, the entirety of the positioning region of the positioning portion is disposed inside the imaginary region, wherein the first condition is that each of ends of the plurality of straight lines is situated at an edge of the electric contacts or at the center of the developing agent bearing member, wherein the second condition is that the center of the developing agent bearing member is situated at an intersection of the plurality of straight lines, or upon one of the straight lines, and wherein the third condition is that each of the straight lines is stipulated so that the area of the imaginary region is maximal, within the constrictions of the first and second conditions.

2. The cartridge according to claim 1, further comprising:

a bearing member configured to bear the developing agent bearing member, wherein the plurality of electric contacts and the positioning region of the positioning portion is provided at the bearing member.

3. A bearing member rotatably supporting a developing agent bearing member provided to a cartridge, the bearing member comprising:

a support portion configured to be in contact with a shaft of the developing agent bearing member and bear the shaft;

a plurality of electric contacts each electrically configured to connect to an apparatus main unit to which the cartridge is mounted; and a positioning portion having a positioning region where the cartridge is positioned in a mounting direction of being mounted to the apparatus main unit, by coming into contact with the apparatus main unit, wherein, on a projection plane orthogonal to an axial line of the developing agent bearing member, forming an imaginary region surrounded by a plurality of straight lines and edges of the electric contacts, while satisfying first, second, and third conditions, the entirety of the positioning region of the positioning portion is disposed inside the imaginary region, wherein the first condition is that each of ends of the plurality of straight lines is situated at an edge of the electric contacts or at the center of the support portion, wherein the second condition is that the center of the support portion is situated at an intersection of the plurality of straight lines, or upon one of the straight lines, and wherein the third condition is that each of the straight lines is stipulated so that the area of the imaginary region is maximal, within the constrictions of the first and second conditions.

* * * * *